US008485746B2

(12) United States Patent
Kosuge

(10) Patent No.: US 8,485,746 B2
(45) Date of Patent: Jul. 16, 2013

(54) CUTTING DEVICE AND TAPE PRINTING APPARATUS EQUIPPED THEREWITH

(75) Inventor: Shinsaku Kosuge, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 237 days.

(21) Appl. No.: 12/974,262

(22) Filed: Dec. 21, 2010

(65) Prior Publication Data

US 2011/0158734 A1 Jun. 30, 2011

(30) Foreign Application Priority Data

Dec. 24, 2009 (JP) ..... 2009-291941

(51) Int. Cl.
*B41J 11/00* (2006.01)
*B26D 5/06* (2006.01)

(52) U.S. Cl.
USPC ..... 400/621; 83/636

(58) Field of Classification Search
USPC ..... 400/621; 83/611, 636, 683, 881, 83/879, 601
See application file for complete search history.

(56) References Cited

U.S. PATENT DOCUMENTS

| | | | | |
|---|---|---|---|---|
| 6,109,154 | A * | 8/2000 | Miyatsu et al. | 83/627 |
| 6,694,854 | B2 * | 2/2004 | Furuya | 83/879 |
| 6,997,095 | B1 * | 2/2006 | Kishi et al. | 83/881 |
| 2005/0186008 | A1 * | 8/2005 | Imai | 400/618 |
| 2005/0286955 | A1 * | 12/2005 | Weeks et al. | 400/621 |
| 2008/0181711 | A1 * | 7/2008 | Monclus et al. | 400/621 |

FOREIGN PATENT DOCUMENTS

| | | |
|---|---|---|
| JP | 2002-103281 | 4/2002 |

* cited by examiner

*Primary Examiner* — Matthew G. Marini
*Assistant Examiner* — Allister Primo

(57) ABSTRACT

A cutting device which carries out a cutting operation on a tape-like member in a width direction thereof, includes: a cutter operation mechanism, as well as making a cutting start position different between a full cutting and a half cutting in the cutting preparation operation, causes a cutter unit to carry out a first cutting operation, which causes the cutter unit to move in the width direction from the cutting start position to a predetermined position, and a second cutting operation, which causes the cutter unit to advance from the predetermined position to the cutting completion position in a direction approximately perpendicular to a tape surface of the tape-like member, on the tape-like member in the cutting operation.

5 Claims, 23 Drawing Sheets

CUTTING DEVICE AND TAPE PRINTING APPARATUS EQUIPPED THEREWITH

The entire disclosure of Japanese Patent Application No. 2009-291941, filed on Dec. 24, 2009, is expressly incorporated by reference herein.

BACKGROUND

1. Technical Field

The present invention relates to a cutting device and a tape printing apparatus equipped therewith.

2. Related Art

Heretofore, a tape printing apparatus has been known which carries out a printing on, while feeding, a tape-like member wherein a printing tape (coated with an adhesive) and release paper are stacked, and when the printing is finished, cuts off a portion on which the printing is done, making a label. The label made is used by stripping the printing tape from the release paper, and affixing it to a desired affixing surface. Also, the cutting has a full cutting, which cuts both the printing tape and release paper of the tape-like member by means of a full cutter, and a half cutting which cuts either the printing tape or release paper by means of a half cutter. By carrying out the half cutting, it is possible to make it easy to strip the printing tape from the release paper.

Structures of a full cutting device and half cutting device incorporated in the tape printing apparatus include, for example, JP-A-2002-103281.

With JP-A-2002-103281, the full cutting device, being configured including a fixed blade and a movable blade pivotably supported on the fixed blade via a pivot, carries out the full cutting in the form of scissors. Also, the half cutting device is configured including a half cutter, which has a cutter blade configured of an inclined blade, and a cutter operation mechanism, which causes the half cutter to carry out a circulatory movement circulating through a cutting stand-by position, a cutting start position, a cutting completion position, and a withdrawal position, and returning to the cutting stand-by position, wherein the half cutter moves in a width direction of the tape-like member, and carries out the half cutting on the tape-like member. Also, the half cutting device, by causing the cutter blade to move along the whole width direction region of the tape-like member, carries out the half cutting.

However, with JP-A-2002-103281, as the cutting device is configured including the full cutting device carrying out the full cutting and the half cutting device carrying out the half cutting separately, there is a problem in that the cutting device becomes larger in size. Along with this, there is a problem in that the tape printing apparatus including the cutting device also becomes larger in size. Also, as the half cutting device needs to cause the cutter blade to move along the whole width direction region of the tape-like member, there is a problem in that the half cutting device becomes larger in size in the movement direction (the width direction of the tape-like member).

Consequently, there has been a demand for a cutting device, with which it is possible to share the full cutting device and half cutting device, and it is possible to achieve a miniaturization in the width direction of the tape-like member, and for a tape printing apparatus including the cutting device.

SUMMARY

An advantage of some aspects of the invention is to solve at least a part of the problems described above and the invention can be embodied as the following forms or application examples.

APPLICATION EXAMPLE 1

According to this application example, there is provided a cutting device which carries out a cutting operation on a tape-like member in a width direction thereof, including a cutter unit having a cutter blade configured of an inclined blade, and a cutter operation mechanism which causes the cutter unit to carry out a circulatory movement including a cutting preparation operation which causes the cutter unit to advance toward the tape-like member from a cutting stand-by position to a cutting start position, the cutting operation which causes the cutter unit to move from the cutting start position to a cutting completion position, a withdrawal operation which causes the cutter unit to retreat from the cutting completion position to a withdrawal position, and a return operation which causes the cutter unit to return from the withdrawal position to the cutting stand-by position. The cutter operation mechanism, as well as making the cutting start position different between a full cutting and a half cutting in the cutting preparation operation, causes the cutter unit to carry out a first cutting operation, which causes the cutter unit to move in the width direction from the cutting start position to a predetermined position, and a second cutting operation, which causes the cutter unit to advance from the predetermined position to the cutting completion position in a direction approximately perpendicular to a tape surface of the tape-like member, on the tape-like member in the cutting operation.

According to this kind of cutting device, by means of the cutter operation mechanism which causes the cutter unit to carry out the circulatory movement, the cutter unit moves in the width direction of the tape-like member, and carries out the cutting operation. Also, as the cutter operation mechanism can change the amount of cutting into the tape-like member by making the cutting start position different between the full cutting and half cutting using the same cutter unit in the cutting preparation operation, it is possible to reliably carry out the full cutting and half cutting. Because of this, a need to configure the cutting device of separate devices, a full cutting device and a half cutting device, is eliminated. Consequently, it is possible to share the full cutting device and half cutting device.

Also, in the cutting operation, the cutter operation mechanism, in the first cutting operation, causes the cutter unit to move in the width direction from the cutting start position to the predetermined position, and in the second cutting operation, causes the cutter unit to advance from the predetermined position to the cutting completion position in the direction approximately perpendicular to the tape surface of the tape-like member. Because of this, a need to cut the tape-like member by causing the cutter unit to move only in the width direction from the cutting start position, as heretofore known, is eliminated, and a cutting is carried out by carrying out the first cutting operation from the cutting start position to a halfway position in the width direction of the tape-like member corresponding to the predetermined position, and carrying out the second cutting operation from the halfway position. Consequently, as it is sufficient to cause the cutter unit having the cutter blade to move to the predetermined position, it is possible to realize a cutting device with which it is possible to achieve a miniaturization in the width direction of the tape-like member.

APPLICATION EXAMPLE 2

In the cutting device according to the application example, it is preferable that the cutter operation mechanism is such that, when it causes the cutter unit to move in the width direction of the tape-like member in the cutting operation, a position in which a movement direction side end of the cutter blade goes beyond an end of the tape-like member corresponding to the movement direction side end of the cutter blade is made the predetermined position.

According to this kind of cutting device, as the position in which the movement direction side end of the cutter blade goes beyond the end of the tape-like member corresponding to the movement direction side of the cutter blade is made the predetermined position, when the second cutting operation is carried out, it is possible, utilizing the inclined blade portion of the cutter blade, to cut a portion of the tape-like member from the predetermined position to the end thereof corresponding to the movement direction side of the cutter blade. Consequently, it is possible to realize the cutting device with which it is possible to achieve the miniaturization in the width direction of the tape-like member.

APPLICATION EXAMPLE 3

In the cutting device according to the application example, it is preferable that the cutter operation mechanism is such that, when the half cutting is carried out, a half-cut region and a full-cut region are formed in the tape-like member.

According to this kind of cutting device, when the half cutting is carried out, as the half-cut region and full-cut region are formed in the tape-like member, even with the cutting device having achieved the miniaturization in the width direction of the tape-like member, it is possible to reliably carry out the half cutting. Then, it is possible to maintain the user-friendliness of the half cutting which makes it easy to strip a cut printing tape from release paper.

APPLICATION EXAMPLE 4

A tape printing apparatus according to this application example includes the heretofore described cutting device, and a printing drive device which carries out a printing on the tape-like member by driving a tape cartridge housing the tape-like member.

According to this kind of tape printing apparatus, as it uses the cutting device with which it is possible to share the full cutting device and half cutting device, and it is possible to achieve the miniaturization in the width direction of the tape-like member, it is possible to realize a miniaturization of the tape printing apparatus. Also, when the width direction of the tape-like member coincides with the thickness (height) direction of the tape printing apparatus, it is possible to reduce the thickness (height) of the tape printing apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereafter, a description will be given of an embodiment, based on the drawings.

Embodiment

Figure 1A:
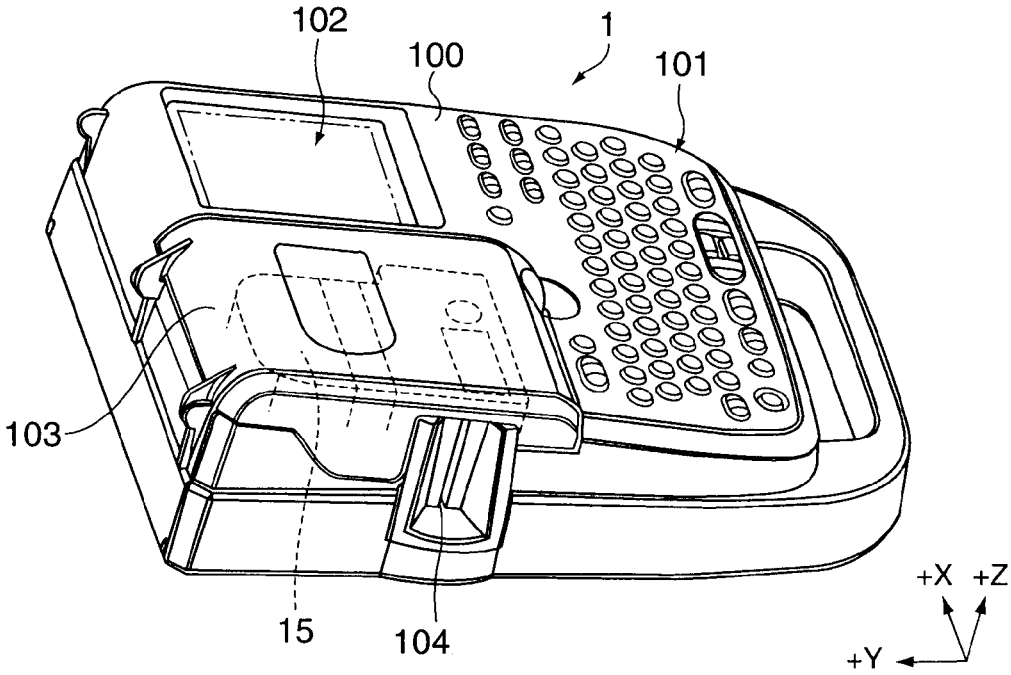
FIGS. 1A and 1B are perspective views of a tape printing apparatus according to an embodiment.
Figure 1B:
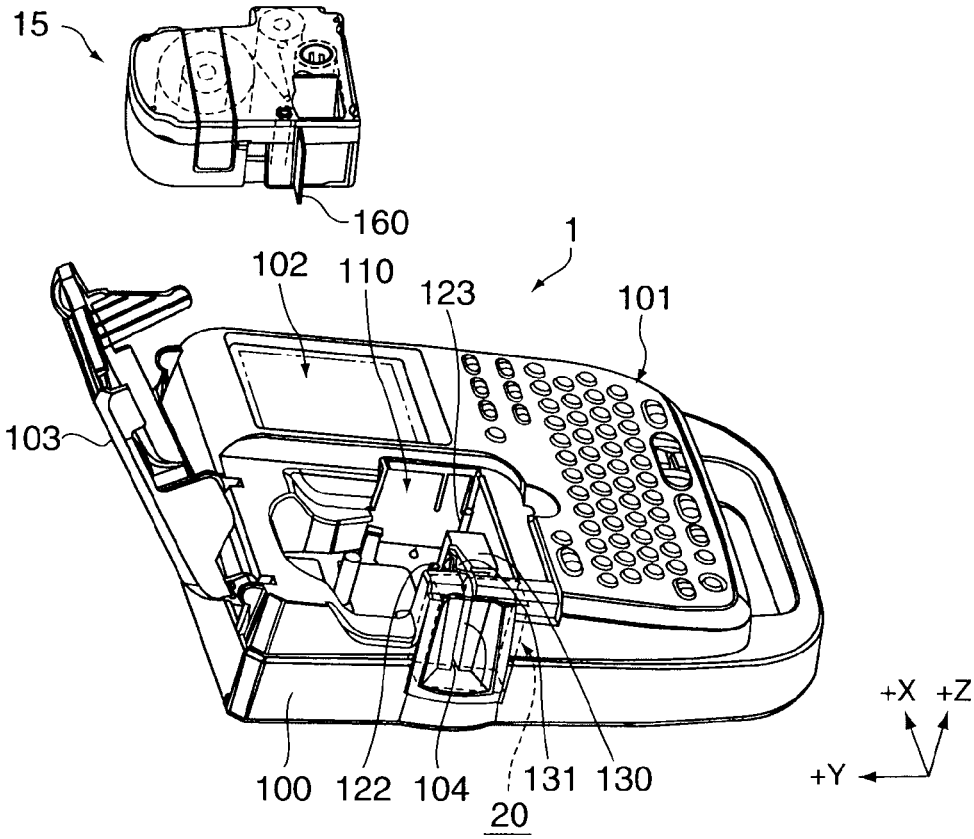

FIGS. 1A and 1B are perspective views of a tape printing apparatus, where FIG. 1A is a perspective view of the tape printing apparatus 1 in a condition in which an opening/closing cover 103 is closed, and FIG. 1B is a perspective view of the tape printing apparatus 1 in a condition in which the opening/closing cover 103 is opened. FIG. 1B shows a condition in which a tape cartridge 15 is removed from a mounting portion 110. With reference to FIGS. 1A and 1B, a description will be given of an external configuration of the tape printing apparatus 1.

In FIGS. 1A and 1B, a direction from an operating panel 101 of the tape printing apparatus 1 to the tape cartridge 15 (from the right to the left of the drawings) is taken to be a Y axis (+Y axis) direction, a direction from a tape ejection slot 104 to the tape cartridge 15 (an upward direction from the bottom of the drawings) an X axis (+X axis) direction, and a direction perpendicular to the Y axis direction and X axis direction a Z axis direction (a direction from the back to the front of the drawings is taken to be a +Z axis direction). The subsequent drawings are shown in the XYZ Cartesian coordinate system defined in FIGS. 1A and 1B. The Z axis direction is a height direction, thickness direction, and up-down direction of the tape printing apparatus 1. Also, in the following description, when describing a direction, the XYZ Cartesian coordinate system will be used as appropriate.

The exterior of the tape printing apparatus 1 is formed of an exterior casing 100. As shown in FIGS. 1A and 1B, the tape printing apparatus 1 has the operating panel 101, which includes various kinds of input key, on a −Y side upper surface of the exterior casing 100. Also, the tape printing apparatus 1 has a display 102 on a +Y side upper surface of the exterior casing 100. Also, the tape printing apparatus 1 has the opening/closing cover 103, which is openable and closeable, adjacent to the display 102. Also, although not shown, a power supply device, various kinds of display lamp, a trimmer device, and the like, are disposed on the exterior casing 100, and a circuit board mounted with a controller which overall controls the operation of the tape printing apparatus 1, and the like, are disposed in the interior of the exterior casing 100.

As shown in FIG. 1B, the mounting portion 110 which removably houses the tape cartridge 15 is provided on the lower side (−Z side) of the opening/closing cover 103. A platen roller rotating shaft 122, an ink ribbon rewinding shaft 123, a printing head unit 130, and the like, extend out into the mounting portion 110. When mounting/removing the tape cartridge 15, the mounting/removing is carried out by opening the opening/closing cover 103. Also, after the mounting/removing of the tape cartridge 15, the opening/closing cover 103 is closed.

As shown in FIG. 1B, in the interior of the exterior casing 100, a cutting device 20 which carries out a full cutting and a half cutting with respect to a tape-like member 160 is disposed on a tape feed direction downstream side (the −X side) of the mounting portion 110. Also, the tape ejection slot 104 through which the fully-cut and separated tape-like member 160 is discharged to the exterior of the apparatus is opened in a side surface of the exterior casing 100 on the tape feed direction downstream side of the cutting device 20.

Figure 2:
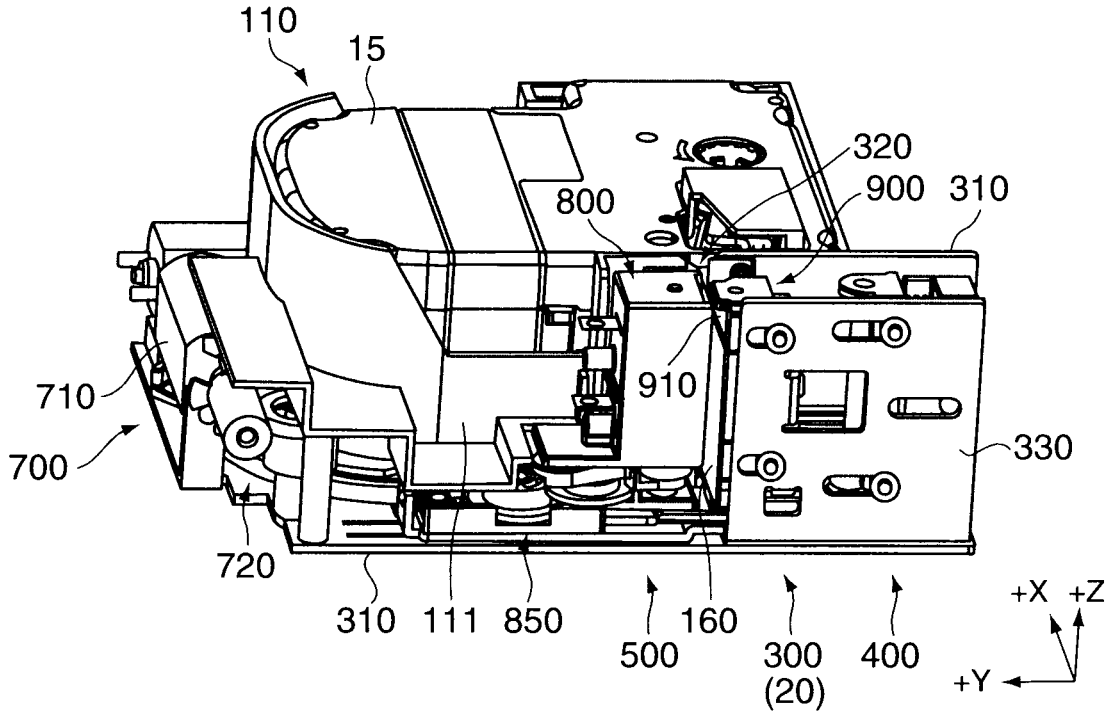
FIG. 2 is a perspective view of a tape cartridge, a printing drive device, and a cutting device.
Figure 3A:
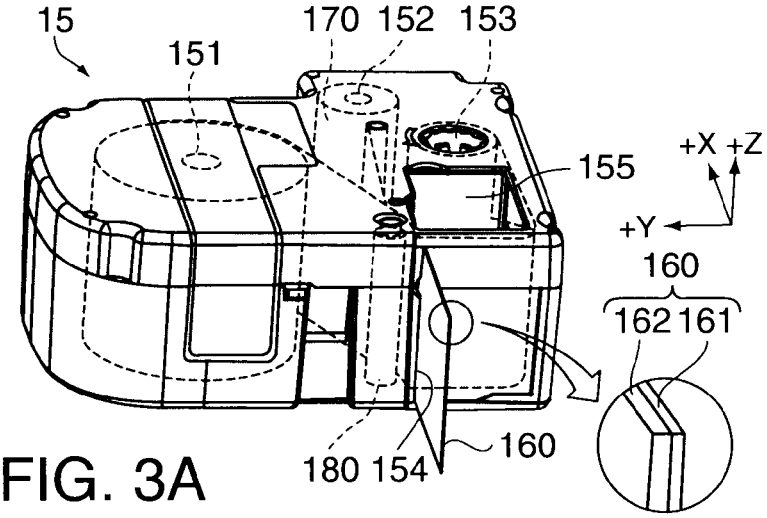
FIGS. 3A to 3C are perspective views of the tape cartridge, printing drive device, and cutting device.
Figure 3B:
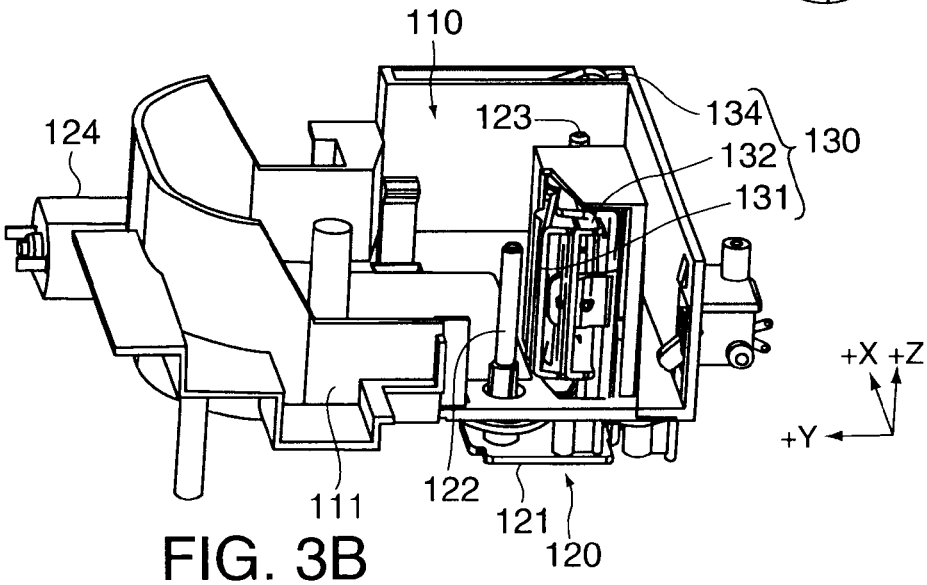
Figure 3C:
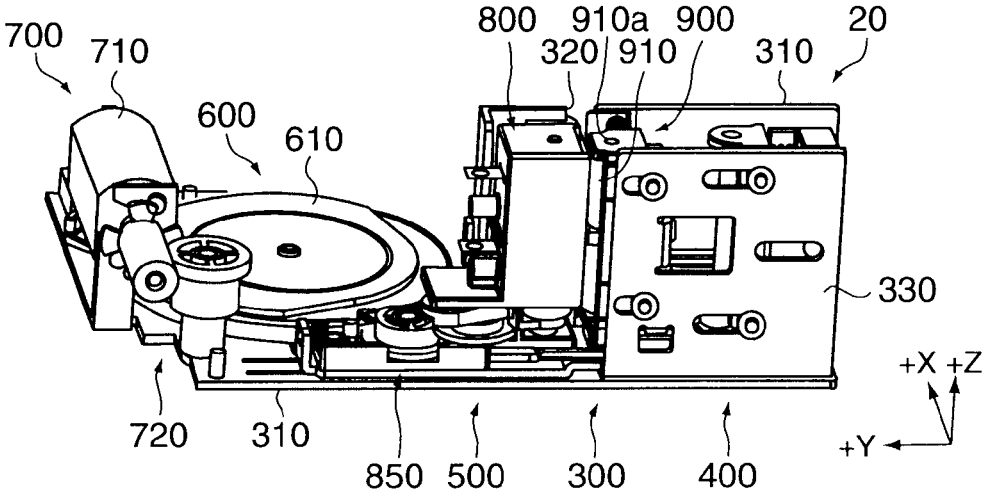

FIG. 2 is a perspective view of the tape cartridge 15, a printing drive device 120, and the cutting device 20 in the interior of the tape printing apparatus 1. FIGS. 3A to 3C are perspective views individually showing the tape cartridge 15, printing drive device 120, and cutting device 20 in FIG. 2, where FIG. 3A is a perspective view of the tape cartridge 15, FIG. 3B is a perspective view of the printing drive device 120, and FIG. 3C is a perspective view of the cutting device 20. With reference to FIGS. 2 and 3A to 3C, a description will be given of outline configurations of the tape cartridge 15, printing drive device 120, and cutting device 20.

As shown in FIG. 2, the tape cartridge 15 is mounted in the mounting portion 110 (a mounting casing 111). The printing drive device 120 (refer to FIG. 3B) which drives the tape cartridge 15 and carries out a printing on the tape-like member 160 is disposed on the lower side (−Z side) of the mounting portion 110. Also, the cutting device 20 of the embodiment is disposed on the lower side (−Z side) of the printing drive device 120 and on the side surface sides (the −X side and +Y side) of the mounting casing 111. In particular, a rotating circular plate 610 configuring a power transmission mechanism 600, to be described hereafter, of the cutting device 20 (a cutter operation mechanism 300) is disposed on the lower side (−Z side) of the printing drive device 120.

As shown in FIG. 3A, a tape feed spool 151 on which is mounted the tape-like member 160 wound into a roll is disposed in the interior of the tape cartridge 15, and the leading end of the tape-like member 160 is in a condition in which it is let out from a tape outlet slit 154 opened in a side wall on the cutting device 20 side. The tape-like member 160 is configured by stacking a printing tape 161 coated with an adhesive, which is a member to be subjected to a printing, and release paper 162.

A platen roller 180 which rotates in engagement with the platen roller rotating shaft 122, to be described hereafter, is disposed in the vicinity of the tape outlet slit 154, and the tape cartridge 15 has an opening portion 155, faced by a printing head 131 across the tape-like member 160, on a side opposite the platen roller 180. Also, a ribbon feed spool 152 and a ribbon rewinding spool 153 are disposed in the vicinity of the opening portion 155. The ribbon feed spool 152 feeds an ink ribbon 170 between the platen roller 180 and printing head 131. The ribbon rewinding spool 153 rotates in engagement with the ink ribbon rewinding shaft 123, to be described hereafter, and rewinds the ink ribbon 170.

In the printing drive device 120, as shown in FIG. 3B, the platen roller rotating shaft 122 and ink ribbon rewinding shaft 123 are rotatably erected on a flat plate-like drive device frame 121. Also, the printing drive device 120 is configured so that the rotative force of a drive motor 124 can be transmitted simultaneously to each of the platen roller rotating shaft 122 and ink ribbon rewinding shaft 123 via a gear train (not shown). Then, these component portions are disposed in such a way as to be hidden underneath the mounting casing 111.

Also, the printing head unit 130 is configured in the printing drive device 120. The printing head 131, such as a thermal head, is held on the printing head unit 130 by a head holder 132 so as to face the platen roller rotating shaft 122. The head holder 132 is pivotable around a head holder shaft (not shown).

When the tape cartridge 15 is mounted in the mounting portion 110 (refer to FIG. 2), the platen roller rotating shaft 122 and platen roller 180 come into engagement, and the ink ribbon rewinding shaft 123 and ribbon rewinding spool 153 come into engagement. Also, the print head unit 130 has a release lever 134 extended from the lower end of the head holder 132 to aside surface of the mounting casing 111. Then, the release lever 134 is operated in conjunction with an opening/closing operation of the opening/closing cover 103 and, in a condition in which the opening/closing cover is closed, the printing head 131 facing the interior of the opening portion 155 of the tape cartridge 15 presses the platen roller 180 while clamping the ink ribbon 170 and tape-like member 160.

Herein, when a printing instruction is given from the controller, the drive motor 124 operates, and the platen roller 180 and ribbon rewinding spool 153 start to rotate. Then, the tape-like member 160 is fed, and ink of the ink ribbon 170 is thermally transferred to the printing tape 161 by the printing head 131, and printed thereon. The tape-like member 160 on which the printing is done is sequentially fed from the tape outlet slit 154 toward the tape ejection slot 104 side. Also, the ink ribbon 170 used in the printing is sequentially rewound around the ribbon rewinding spool 153.

Furthermore, the printed tape-like member 160 fed from the tape outlet slit 154 of the tape cartridge 15 is fed into the interior of the cutting device 20 through a guide slit 320 formed in a base frame 310 of the cutting device 20 (refer to FIG. 3C). The tape-like member 160 having entered the interior of the cutting device 20 through the guide slit 320 is fed to the tape ejection slot 104 side through an interspace formed by a tape discharge mechanism 800, which has a tape receiving surface 843*a* (refer to FIG. 9) and a tape discharge roller 820 (refer to FIG. 9), and a tape pressing mechanism 900, which has a tape pressing roller 910 disposed facing the tape discharge roller 820.

When mounting the tape cartridge 15 in the mounting portion 110, the tape-like member 160 extending from the tape outlet slit 154 is inserted into the interspace between the tape discharge roller 820 of the tape discharge mechanism 800 and tape pressing roller 910 of the tape pressing mechanism 900 from above (the +Z direction).

With reference to FIG. 3C, a description will be given of an outline of a mechanism system configuring the cutting device 20. The cutting device 20 is configured in the upper portion of the mechanism system with the frame 310 as a reference. The cutting device 20 includes a cutter unit 200 (refer to FIGS. 4A and 4B) having a cutter blade 210 (refer to FIGS. 4A and 4B), to be described hereafter, and a cutter operation mechanism 300, to be described hereafter, which causes the cutter unit 200 to carry out a circulatory movement including a cutting preparation operation, a cutting operation, a withdrawal operation, and a return operation. Also, the tape discharge mechanism 800 and tape pressing mechanism 900, to be described hereafter, are included in the cutting device 20. Also, with the cutting device 20 of the embodiment, it is possible to carry out the full cutting and half cutting with one common cutter unit 200. In other words, it is possible to carry out the full cutting and half cutting by sharing the cutter unit 200.

Figure 4A:
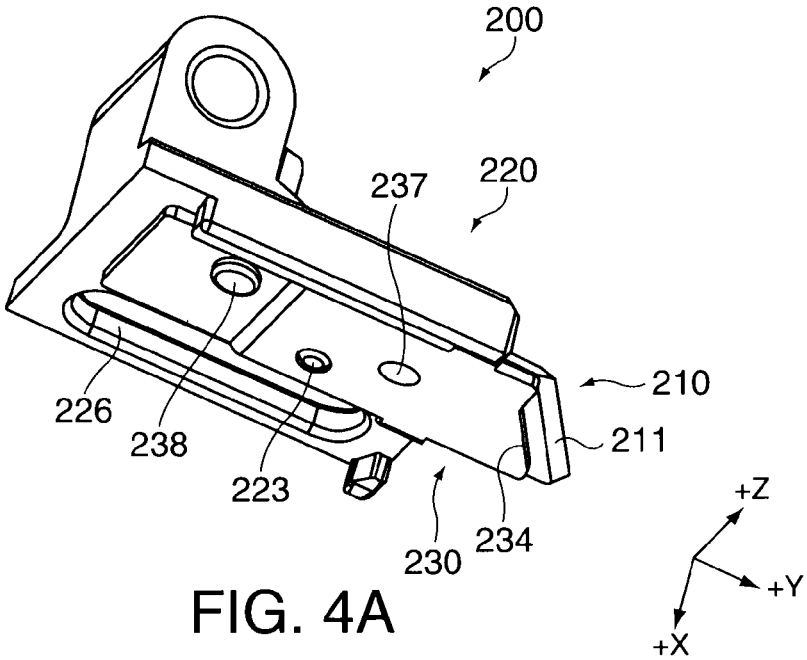
FIGS. 4A and 4B are perspective views of a cutter unit.
Figure 4B:
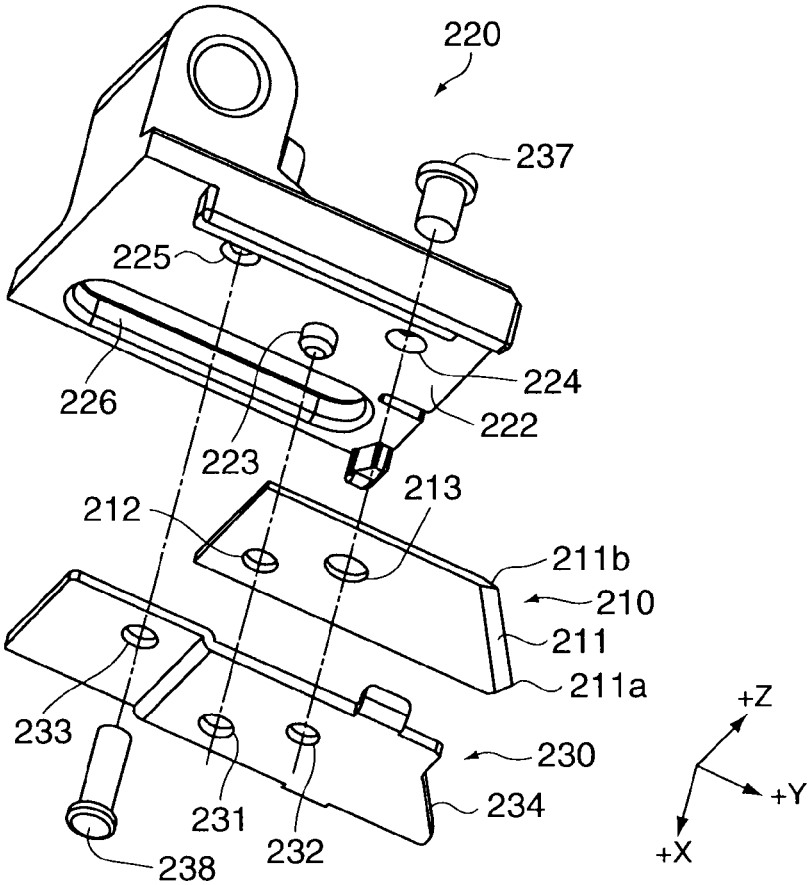

FIGS. 4A and 4B are perspective views showing the cutter unit 200. FIG. 4A is a completion diagram of the cutter unit 200, and FIG. 4B is an assembly diagram of the cutter unit 200. A description will be given of the cutter unit 200.

The cutter unit 200 is a unit which is slidably guided by a guide shaft 430, to be described hereafter, and cuts the tape-like member 160. The cutter unit 200 is configured of the cutter blade 210 configured of an inclined blade, a cutter holder 220 holding the cutter blade 210, and a cutter cover 230 which fixes the cutter blade 210 by tucking it into the cutter holder 220.

As shown in FIG. 4A, the cutter unit 200 is fixed in a condition in which a blade edge 211 of the cutter blade 210 is projected in the +Y direction from an end face of an attachment surface 222 of the cutter holder 220. Also, the cutter unit 200 fixes the cutter blade 210, by means of an inclined surface 234 formed on the cutter cover 230, in a condition in which the blade edge 211 is uniformly exposed.

In order to assemble the cutter unit 200, as shown in FIG. 4B, the blade edge 211 is caused to face in the upward direction (+Z direction), and a positioning hole 212 of the cutter blade 210 is engaged with a positioning projection 223 of the cutter holder 220. Also, a positioning hole 231 of the cutter cover 230 is engaged with the positioning projection 223 passing through the positioning hole 212 of the cutter blade 210, thus covering the cutter blade 210.

Next, a fixing screw 237 is caused to pass through a fixing hole 224 and a fixing hole 213 of the cutter blade 210 from the bottom side (−X side) of the cutter holder 220, and is screwed in a fixing hole 232 of the cutter cover 230. Also, a fixing screw 238 is caused to pass through a fixing hole 233 from the top side (+X side) of the cutter cover 230, and is screwed in a fixing hole 225 of the cutter holder 220. By this means, the cutter holder 220 clamps the cutter blade 210 with the cutter cover 230, thus fixing the cutter blade 210.

The cutter operation mechanism 300 includes a first movement mechanism 400, a second movement mechanism 500, and the power transmission mechanism 600. The first movement mechanism 400 is a mechanism which causes the cutter unit 200 to move in a front-back direction (the Y axis direction) relative to the tape-like member 160. Also, the second movement mechanism 500 is a mechanism which causes the cutter unit 200 to move in the up-down direction (Z axis direction) relative to the tape-like member 160. Also, the power transmission mechanism 600 is a mechanism which branches power and transmits it to the first movement mechanism 400 and second movement mechanism 500, and brings the first movement mechanism 400 and second movement mechanism 500 into conjunction, causing the cutter unit 200 to carryout the circulatory movement. Also, the power transmission mechanism 600 also branches power and transmits it to the tape discharge mechanism 800.

Figure 5B:
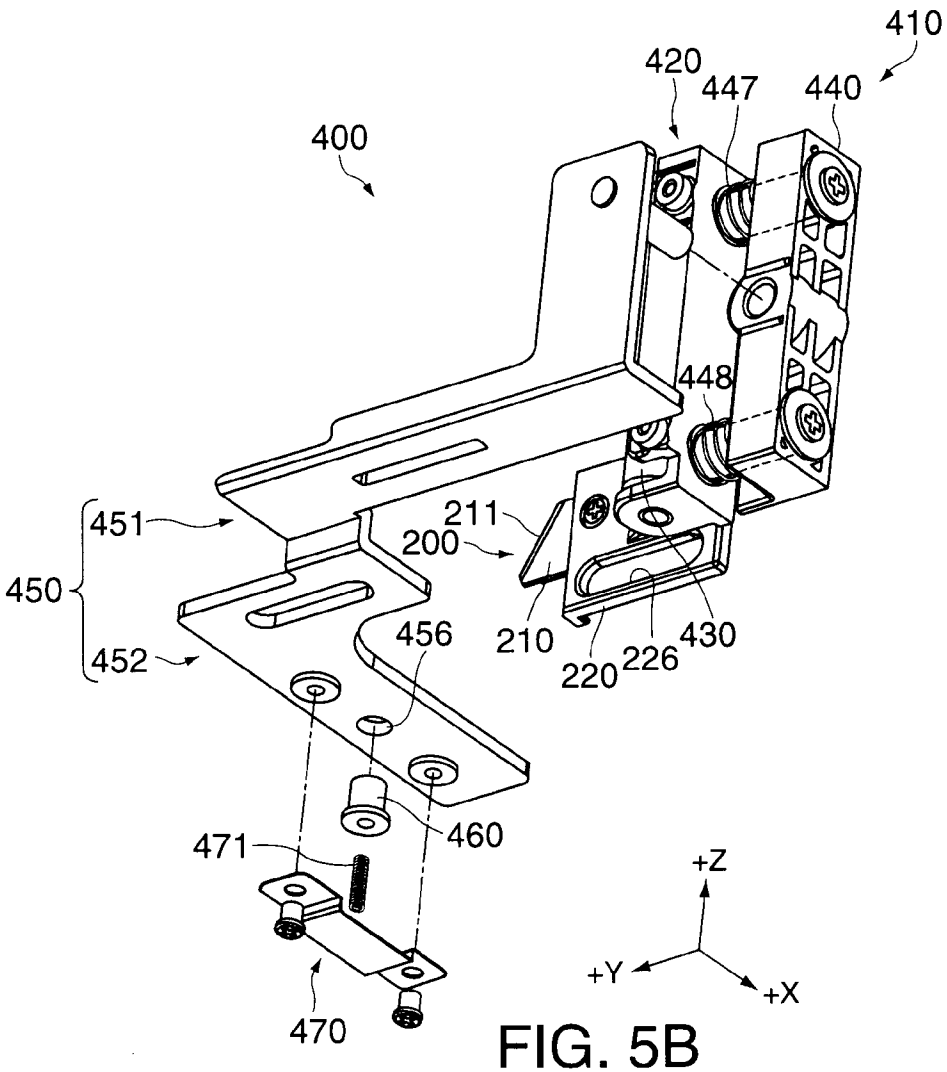
FIGS. 5A and 5B are perspective views of a first movement mechanism.
Figure 5A:
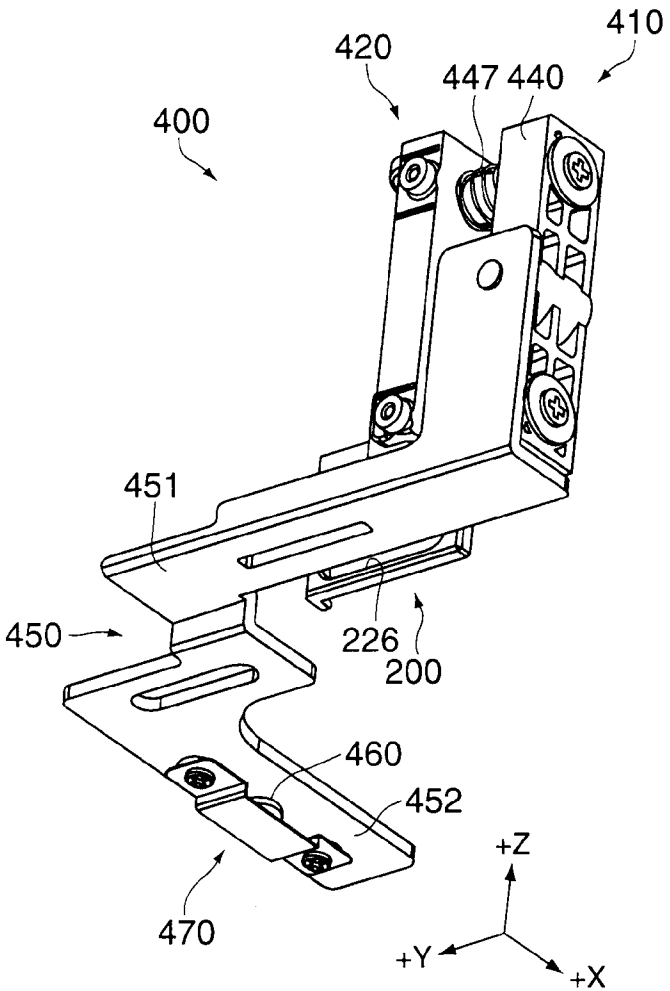

FIGS. 5A and 5B are perspective views showing the first movement mechanism 400. FIG. 5A is a completion diagram of the first movement mechanism 400, and FIG. 5B is an assembly diagram of the first movement mechanism 400. With reference to FIGS. 5A and 5B, a description will be given of a configuration of the first movement mechanism 400.

The first movement mechanism 400 is a mechanism which causes the cutter unit 200 to move in the front-back direction (Y axis direction) relative to the tape-like member 160. In the embodiment, the first movement mechanism 400 causes the cutter unit 200 to carryout the cutting preparation operation, withdrawal operation, and in addition, one portion of the cutting operation. The first movement mechanism 400 is configured of a cutter sliding unit 410 and a first plate 450 configuring the rotating circular plate 610, and a planar cam mechanism 670, of the power transmission mechanism 600. The cutter sliding unit 410 is configured of a guide shaft unit 420, a unit support casing 440, which supports the guide shaft unit 420 by applying an appropriate pressing force thereto, and two pressing springs 447 and 448 which are a pressing force generation source.

The first plate 450 brings the rotating circular plate 610 and cutter sliding unit 410 into conjunction. The first plate, being formed of a plate material, is configured of a unit holding portion 451, which connects and holds the cutter sliding unit 410, and a cam arm 452 connected to the rotating circular plate 610.

A cam projection hole 456 for engaging a cam projection 460 from below with a planar cam groove 620 formed in the rotating circular plate 610, to be described hereafter, is formed in the cam arm 452. Also, the cam arm 452 includes a pressing spring 471 as a spring member for holding and fixing the cam projection 460 in the cam projection hole 456 so that the cam projection 460 is retractable (retractable in the Z direction), thus configuring a projection holding portion 470.

Figure 6A:
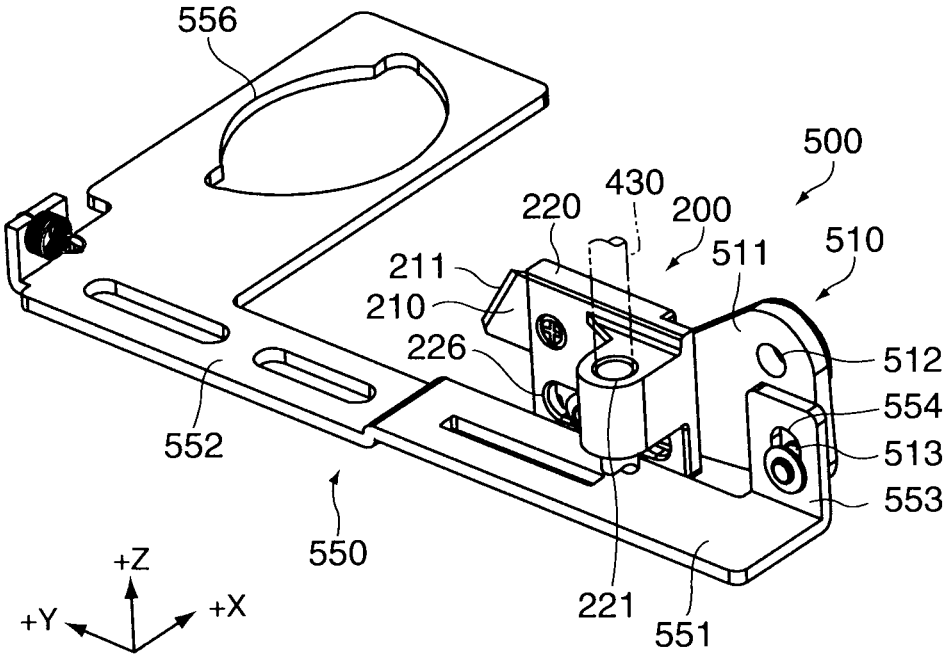
FIGS. 6A and 6B are perspective views of a second movement mechanism.
Figure 6B:
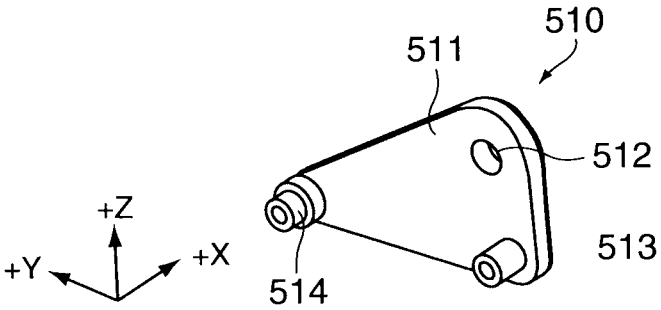

FIGS. 6A and 6B are perspective views showing the second movement mechanism 500, where FIG. 6A is a completion diagram of the second movement mechanism 500, and FIG. 6B is a perspective view of a swaying plate 510. In FIGS. 6A and 6B, for convenience of description, a depiction of the cutter sliding unit 410 (the first movement mechanism 400 having the guide shaft unit 420) is omitted. With reference to FIGS. 6A and 6B, a description will be given of configurations of the second movement mechanism 500 and swaying plate 510.

The second movement mechanism 500 is a mechanism which causes the cutter unit 200 to move in the up-down direction (Z axis direction) along the guide shaft 430. Also, the second movement mechanism 500 causes the cutter unit 200 to move in the up-down direction, thereby causing it to carry out the cutting operation or return operation with respect to the tape-like member 160. The second movement mechanism 500 is configured of the cutter sliding unit 410, a second plate 550 configuring the rotating circular plate 610, and a crank mechanism 680, of the power transmission mechanism 600, and the swaying plate 510 which has one end swayingly connected to the cutter unit 200 and the other end swayingly connected to the second plate 550.

The second plate 550 interlocks the rotating circular plate 610 and cutter sliding unit 410. The second plate 550 is configured of a swaying plate holding portion 551, which swayingly connects and holds the swaying plate 510, and a crank arm 552 connected to the rotating circular plate 610. A sliding slot 554 for swaying the swaying plate 510, to be described hereafter, is formed in a wall 553 of the swaying plate holding portion 551. A crank hole 556 for engaging from below with a crank projection 630 projectingly disposed on the rotating circular plate 610 is formed in the crank arm 552.

As shown in FIG. 6B, the swaying plate 510 has a plate main body 511, and a pivotal aperture 512, which is a swaying center, and a first sliding shaft 513 and second sliding shaft 514 erected in a direction (the −X direction) perpendicular to the surface of the plate main body 511 are configured in the vicinity of the corners of the outer shape of the plate main body 511. The first sliding shaft 513 is slidably connected to the second plate 550, and the second sliding shaft 514 is slidably connected to the cutter unit 200. Because of this, as a result, the swaying plate 510 carries out a swaying around the pivotal aperture 512.

Figure 7:
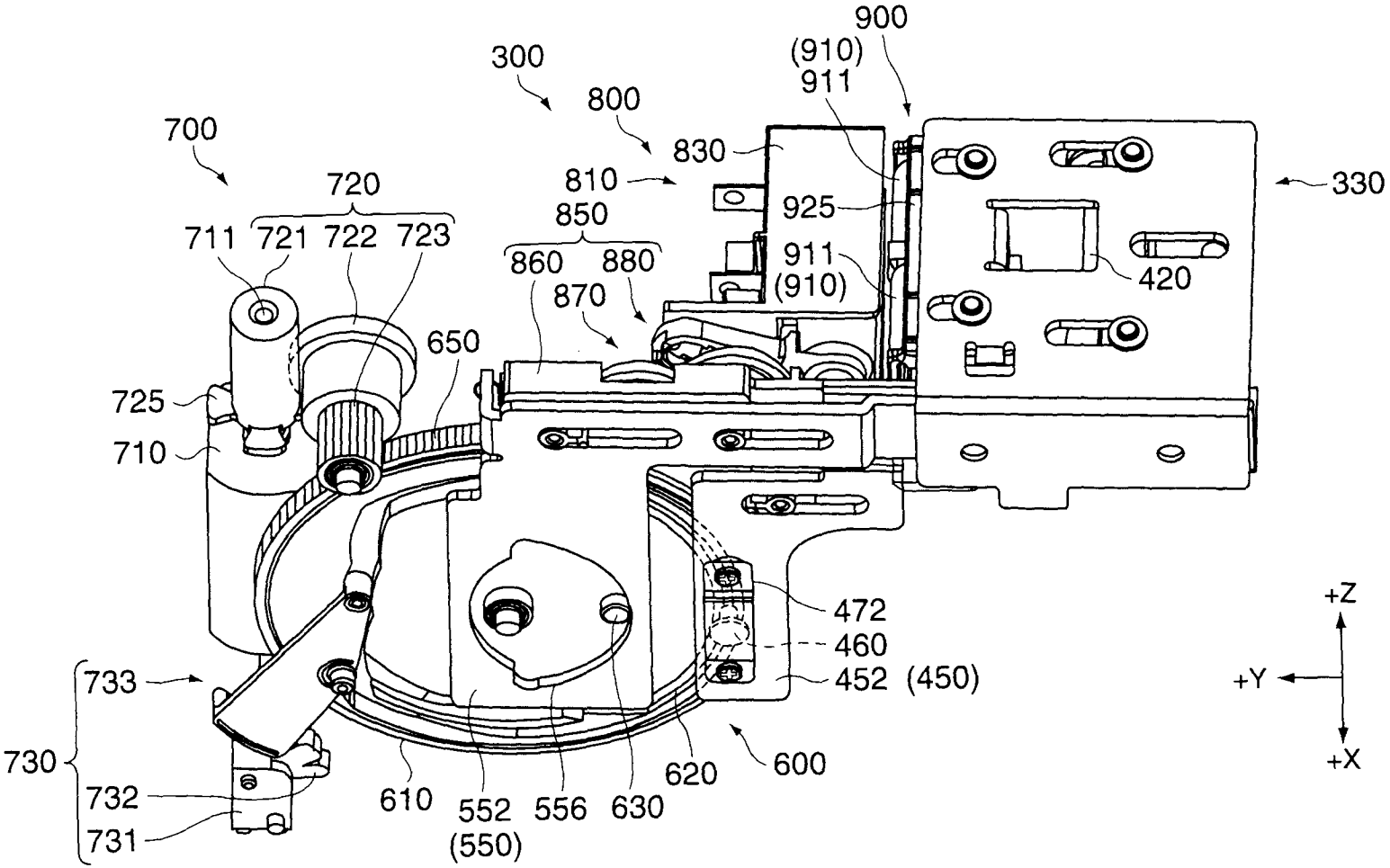
FIG. 7 is a perspective view of a cutter operation mechanism.

FIG. 7 is a perspective view of the power transmission mechanism 600 of the cutter operation mechanism 300 and a drive portion 700 as seen from below. FIG. 7 shows a condition in which a sub-frame 330, the tape discharge mechanism 800, and the tape pressing mechanism 900 are disposed.

The power transmission mechanism 600 includes the rotating circular plate 610 which rotates by means of power input from the drive portion 700. The drive portion 700 has a drive motor 710 and the gear train 720 which is driven by the rotation of the drive motor 710 to rotate the rotating circular plate 610.

Although details are described hereafter, the rotating circular plate (power transmission mechanism 600) rotates by means of the drive portion 700, and power caused by the rotation is branched and transmitted to the first movement mechanism 400 and second movement mechanism 500, and the cutter operation mechanism 300 operates in conjunction therewith. By carrying out the circulatory movement including the cutting preparation operation, cutting operation, withdrawal operation, and return operation by means of the operation of the cutter operation mechanism 300, the cutter unit 200 cuts the tape-like member 160.

Herein, a description will be given of a configuration of the drive portion 700.

The drive portion 700 is a component portion which transmits a rotative force to the rotating circular plate 610 configuring the power transmission mechanism 600. As shown in FIG. 7, the drive portion 700 is configured of the drive motor 710 the gear train 720, which is driven by the rotation of the drive motor 710 to transmit the power to the rotating circular plate 610, and a detection switch portion 730, which detects whether or not the cutter blade 210 is in a cutting stand-by position. The gear train 720 is configured of a worm 721 press-fitted around a motor shaft 711 of the drive motor 710 and a worm wheel 722 meshing with the worm 721. Also, the worm wheel 722 has integrally formed in the lower portion thereof a transmission gear 723 which transmits the power in mesh with a gear portion 650 formed on the outer periphery of the rotating circular plate 610.

The drive motor 710 carries out a forward direction rotation and a backward direction rotation. Consequently, the rotating circular plate 610 also carries out a forward direction rotation and a backward direction rotation by means of the drive portion 700. Also, as a rotation speed detection member 725 is disposed on the motor shaft 711, it is also possible to detect the rotation speed of the drive motor 710.

As shown in FIG. 7, the detection switch portion 730 is configured of a detection switch 731, which has a detection lever 732, and a detection arm 733 which abuts with the detection lever 732. The detection switch portion 730 is a component portion which detects whether or not the half cutting or full cutting by the cutting device 20 has been completed. The detection switch portion 730 outputs a detection result (ON/OFF) to the controller (not shown) included in the tape printing apparatus 1. The detection switch portion 730 operates in engagement with the planar cam groove 620 of the rotating circular plate 610, and detects whether or not the half cutting or full cutting has been completed.

Figure 8:
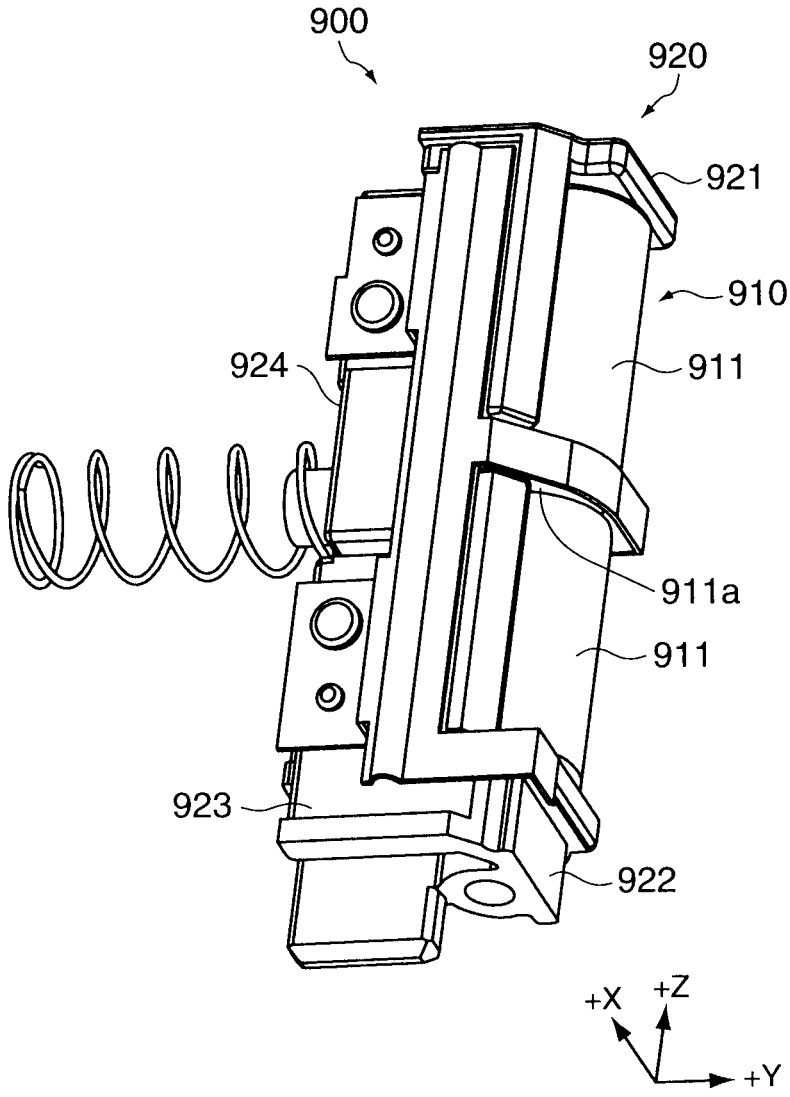
FIG. 8 is a perspective view of a tape pressing mechanism.

FIG. 8 is a perspective view of the tape pressing mechanism 900. With reference to FIG. 8, a description will be given of a configuration of the tape pressing mechanism 900.

The tape pressing mechanism 900 is a device which is driven to move by the first movement mechanism 400 and, while the cutter unit 200 is carrying out the cutting operation which full-cuts or half-cuts the tape-like member 160, presses and clamps the tape-like member 160 together with the tape discharge mechanism 800, to be described hereafter, disposed facing the tape pressing mechanism 900, thus preventing a movement of the tape-like member 160. The tape pressing mechanism 900 is configured of a tape pressing roller 910 and a tape holding casing 920 which rotatably holds the tape pressing roller 910. The tape pressing roller 910 has a rotating shaft 910*a* (refer to FIG. 3C), and a pressing portion 911 formed of an approximately cylindrical member is disposed on the outer periphery of the rotating shaft 910*a*. A concave groove 911*a* is formed in the approximately central portion of the pressing portion 911 in such away as to separate the upper stage and lower stage. The pressing portion 911 is configured of an elastic member and, in the embodiment, a rubber-based member is used.

The tape holding casing 920 is formed into an approximate box of which a side (the +Y side) is opened on which the tape discharge mechanism 800 (refer to FIG. 9) is disposed facing the tape holding casing 920. Particularly, the tape holding casing 920 is configured of an upper plate 921 and lower plate 922, which rotatably hold the tape pressing roller 910 from above and below, and three side plates 923, 924, and 925 (refer to FIG. 7) which connect three directions of end faces of the upper plate 921 and lower plate 922.

Figure 9:
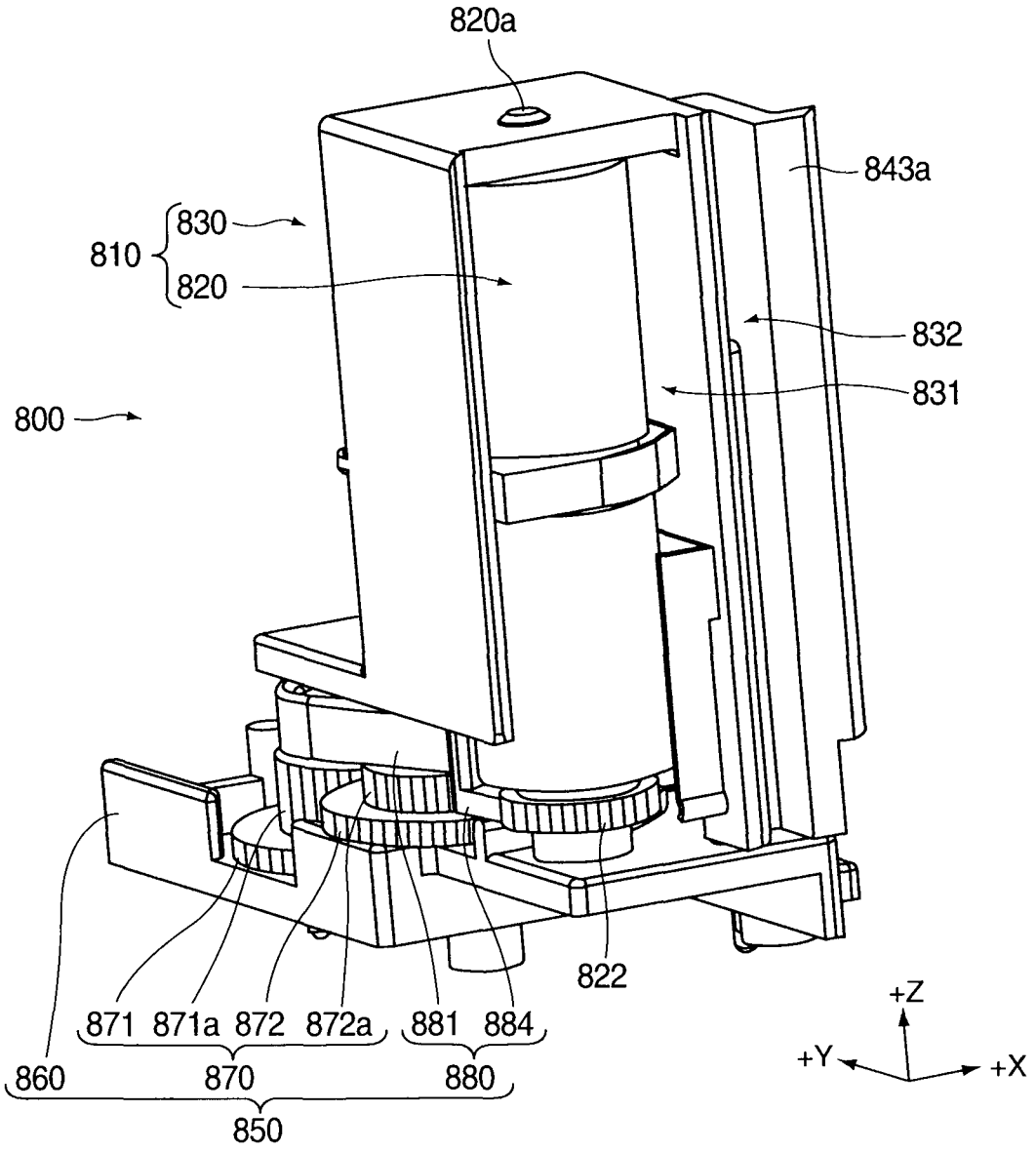
FIG. 9 is a perspective view of a tape discharge mechanism.
Figure 10:
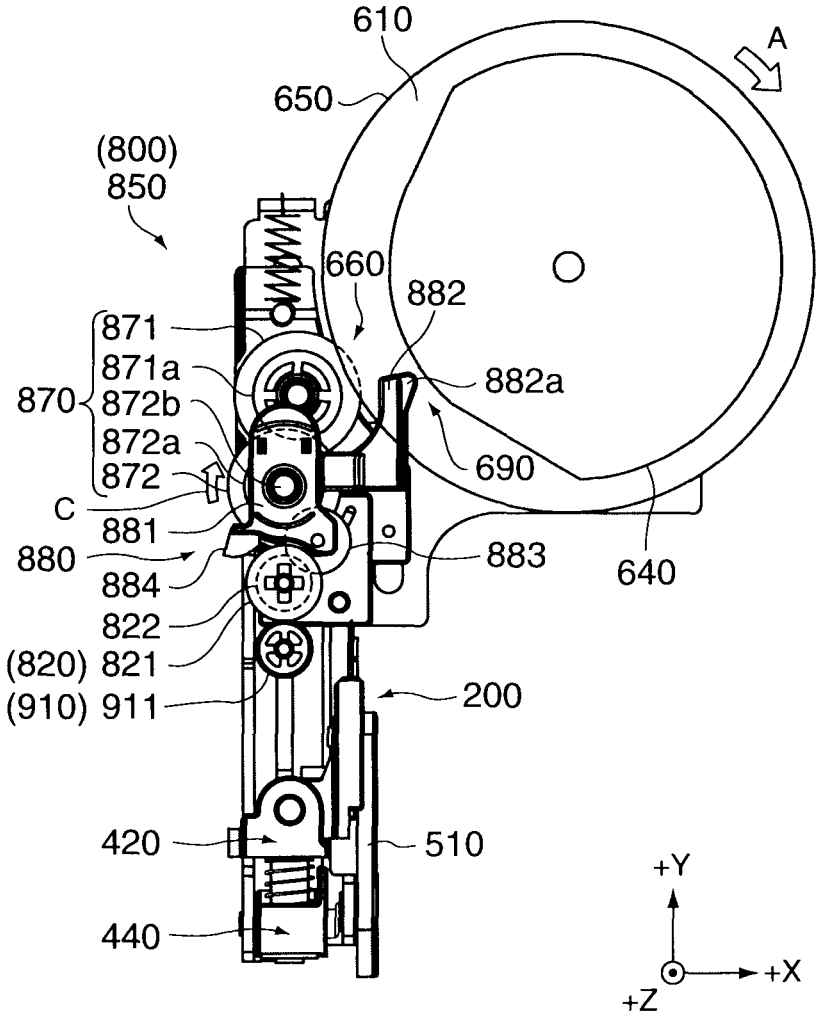
FIG. 10 is a main portion side view and main portion plan view of the tape discharge mechanism.

FIG. 9 is a perspective view of the tape discharge mechanism 800. FIG. 10 is a plan view of a main portion including the tape discharge mechanism 800. FIG. 10 depicts the main portion with necessary component portions extracted in order to illustrate an operation of the tape discharge mechanism 800. With reference to FIGS. 9 and 10, a description will be given of an outline of a configuration and operation of the tape discharge mechanism 800.

The tape discharge mechanism 800 is a device which, while the cutter unit 200 is carrying out the half cutting or full cutting on the tape-like member 160, presses and clamps the tape-like member 160 together with the tape pressing mechanism 900 disposed facing the tape discharge mechanism 800, thus preventing a movement of the tape-like member 160. Also, the tape discharge mechanism 800 is a device which, after the cutter unit 200 has full-cut the tape-like member 160 and finished the cutting operation, by rotating the tape discharge roller 820, to be described hereafter, moves (discharges) the cut and separated tape-like member 160 toward the tape ejection slot 104 of the tape printing apparatus 1.

The tape discharge mechanism 800 is configured of a tape discharge roller unit 810 and a discharge drive portion 850. The tape discharge roller unit 810 is configured of the tape discharge roller 820 and a tape discharge casing 830 which rotatably holds the tape discharge roller 820. Also, the tape discharge casing 830 functionally has a roller housing portion 831, which houses the tape discharge roller 820, and a cutter blade clearance portion 832 into which the cutter blade 210 (blade edge 211) retreats when the cutter unit 200 cuts the tape-like member 160.

A pressing portion 821 formed of an approximately cylindrical member is disposed on the outer periphery of a rotating shaft 820*a* of the tape discharge roller 820. Also, the tape discharge roller 820 is such that a roller rotating gear 822 fixed to the rotating shaft 820*a* is disposed below the pressing portion 821.

Next, a description will be given of a configuration of the discharge drive portion 850.

As shown in FIGS. 9 and 10, the discharge drive portion 850 is a mechanism portion which transmits the rotation of the rotating circular plate 610 to the tape discharge roller 820, causing the tape discharge roller 820 to rotate, and cuts off the transmission, prohibiting the rotation of the tape discharge roller 820.

The discharge drive portion 850 is configured of a transmission gear train 870, a clutch portion 880, and a drive portion casing 860 in which the transmission gear train 870 and clutch portion 880 are incorporated. The transmission gear train 870 transmits power, which is a source of driving (rotating) the tape discharge roller 820, to the clutch portion 880. The clutch portion 880 transmits the power of the transmission gear train 870, causing the tape discharge roller 820 to rotate, and cuts off the power of the transmission gear train 870, prohibiting the rotation of the tape discharge roller 820.

The transmission gear train 870 has a first gear 871, which engages with the gear portion 650 formed on the outer periphery of the rotating circular plate 610 and transmits the rotation of the rotating circular plate 610, and a transmission gear 871*a* connected to the first gear 871. Also, the transmission gear train 870 has a second gear 872, which engages with the first gear 871 (transmission gear 871*a*) and transmits the rotation to a subsequent stage gear, and a transmission gear 872*a* connected to the second gear 872. The discharge drive portion 850 is such that the transmission gear train 870 and gear portion 650 come into engagement, configuring a transmission mechanism 660 with the rotating circular plate 610.

The clutch portion 880 has a clutch casing 881 which is fitted around a rotating shaft 872*b* of the second gear 872 with a predetermined friction. Also, the clutch portion 880 has a clutch lever 882 extending from the +X side end of the clutch casing 881. Also, the clutch portion 880 has a clutch gear portion 883 which, being rotatably disposed at one corner of the −Y side end of the clutch casing 881, acts as a clutch gear portion engaging with the second gear 872 (transmission gear 872*a*). The clutch gear portion 883, when it engages with the roller rotating gear 822 of the tape discharge roller 820, which is a subsequent stage gear, transmits the rotation of the second gear 872 (transmission gear 872*a*) to the roller rotating gear 822, causing the tape discharge roller 820 to rotate.

Also, the clutch portion 880 has a gear stopper 884 which, being disposed fixed to the other corner of the −Y side end of the clutch casing 881, acts as a fixed gear portion. The gear stopper 884, when it engages with the roller rotating gear 822 of the tape discharge roller 820, by prohibiting the rotation of the roller rotating gear 822, prohibits the rotation of the tape discharge roller 820.

The clutch casing 881, by being fitted around the rotating shaft 872*b* of the second gear 872 with the predetermined friction, as heretofore described, is given a sliding load, and tends to rotate in a rotation direction of the second gear 872. Consequently, the clutch lever 882, clutch gear portion 883, and gear stopper 884 disposed on the clutch casing 881 are also driven by the operation of the clutch casing 881.

The diagram shown in FIG. 10 shows a condition in which the cutter blade 210 has finished the full cutting, has retracted from the cutting completion position to the withdrawal position, and is lowering to the cutting stand-by position. In this condition, the rotating circular plate 610 is carrying out the forward direction rotation (a clockwise rotation) shown by an arrow A, and the second gear 872 of the transmission gear train 870 also carries out the forward direction rotation shown by an arrow C. Because of this, by the clutch gear portion 883 of the discharge drive portion 850 meshing with the roller rotating gear 822 of the tape discharge roller 820, the tape discharge roller 820 rotates, and the cut tape-like member 160 is discharged from the tape outlet slit 154 disposed on the −X side.

Figure 11A:
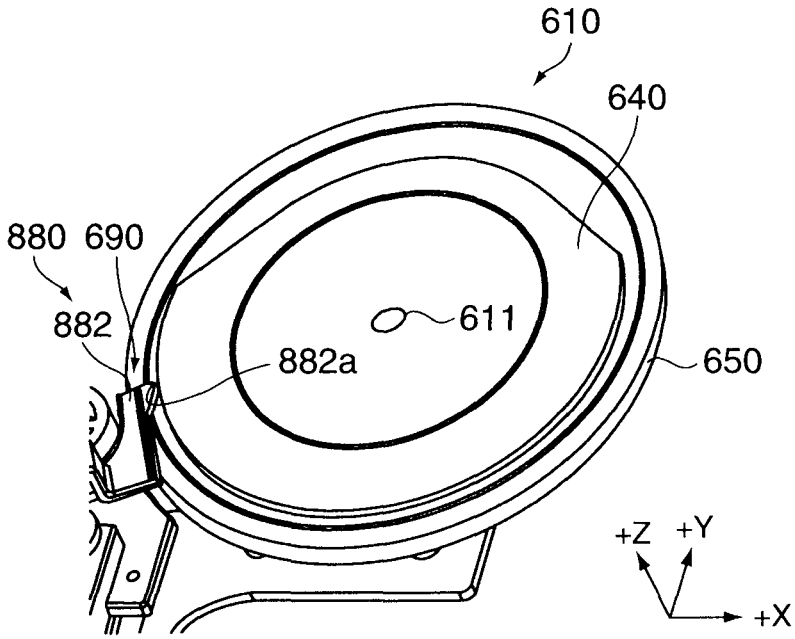
FIGS. 11A and 11B are perspective views of a rotating circular plate seen from the top side and the bottom side.
Figure 11B:
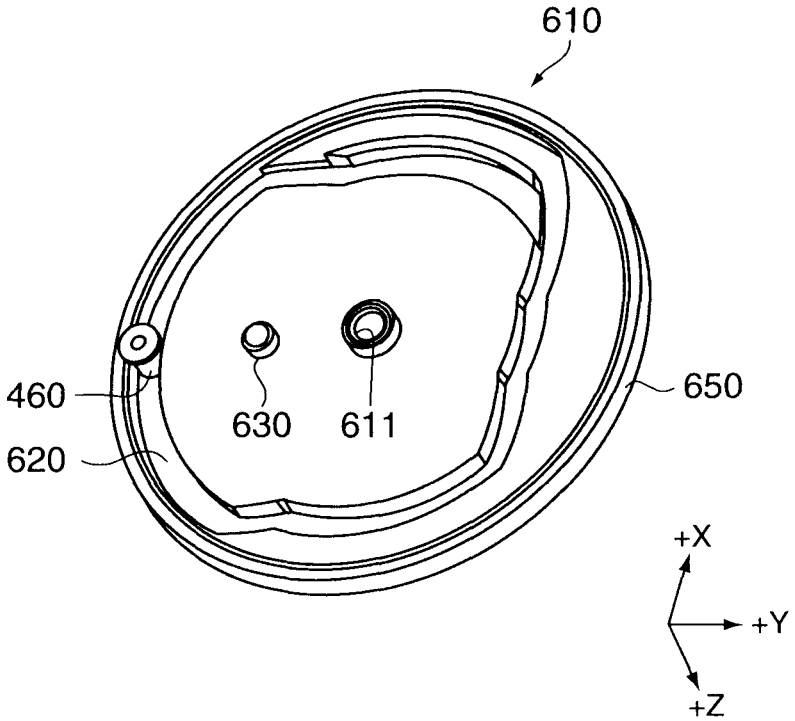
Figure 12A:
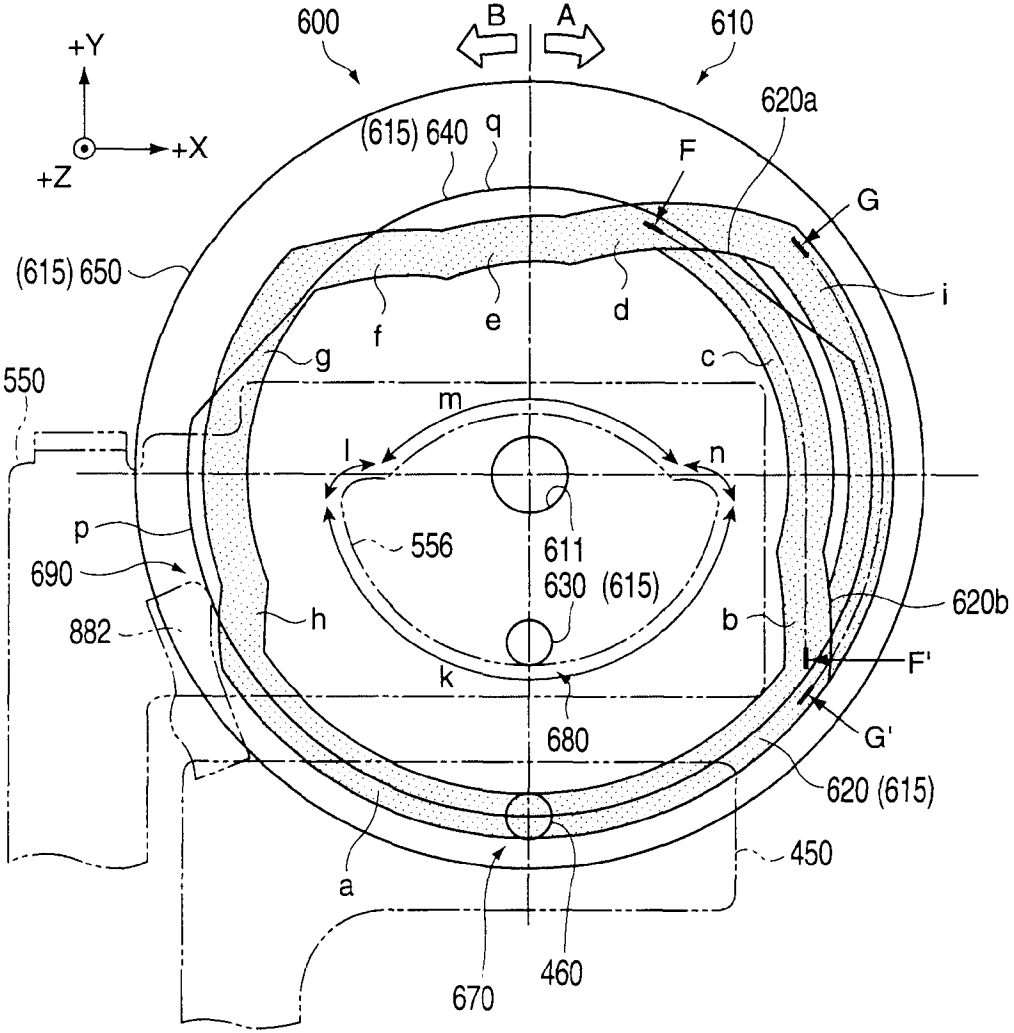
FIGS. 12A to 12C are a plan view of the rotating circular plate, and sectional views of a planar cam groove.
Figure 12B:
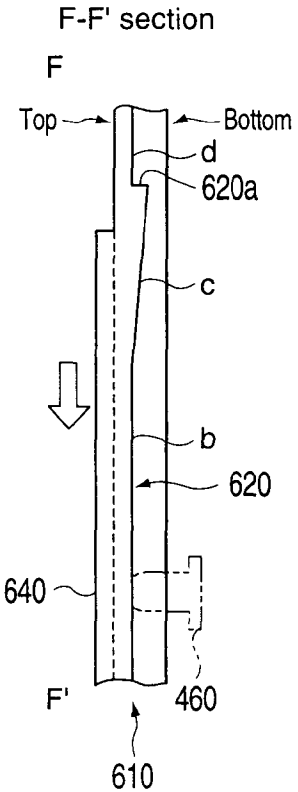
Figure 12C:
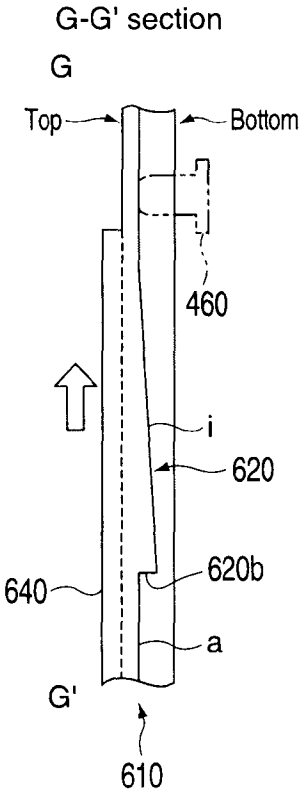
Figure 13A:
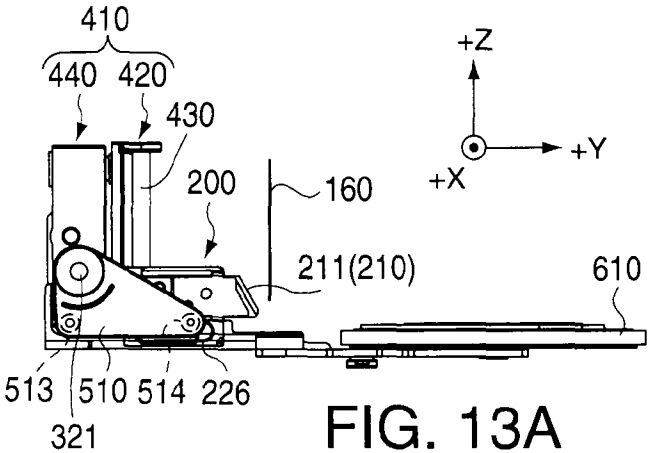
FIGS. 13A to 13D are operational illustrations of the cutting device at a full cutting time.
Figure 13B:
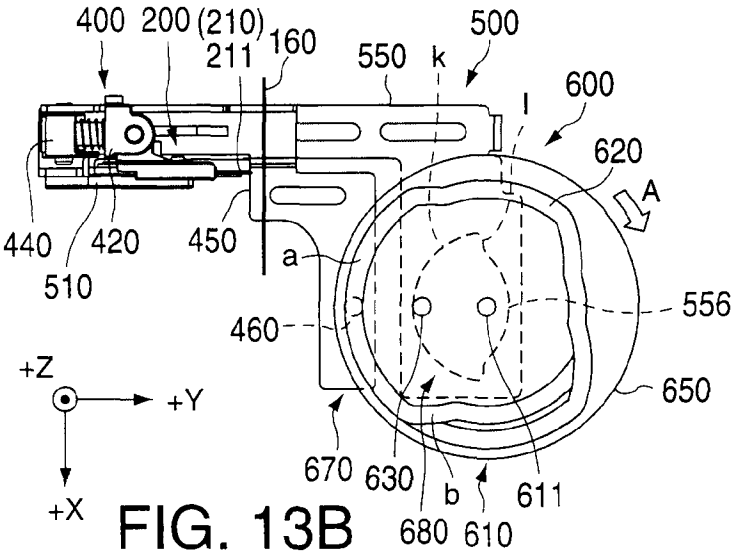
Figure 13C:
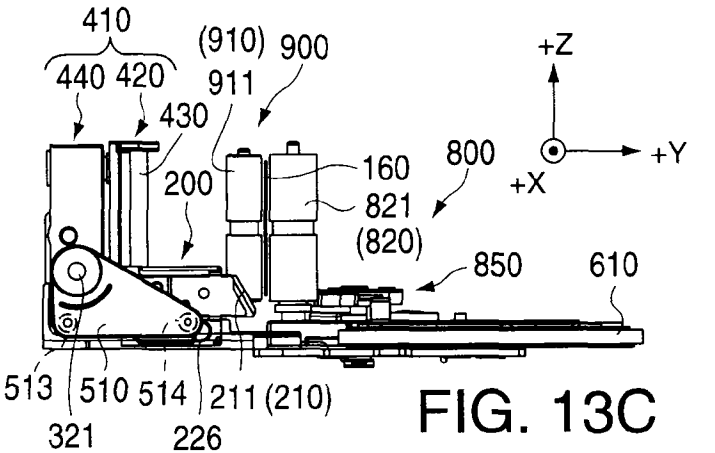
Figure 13D:
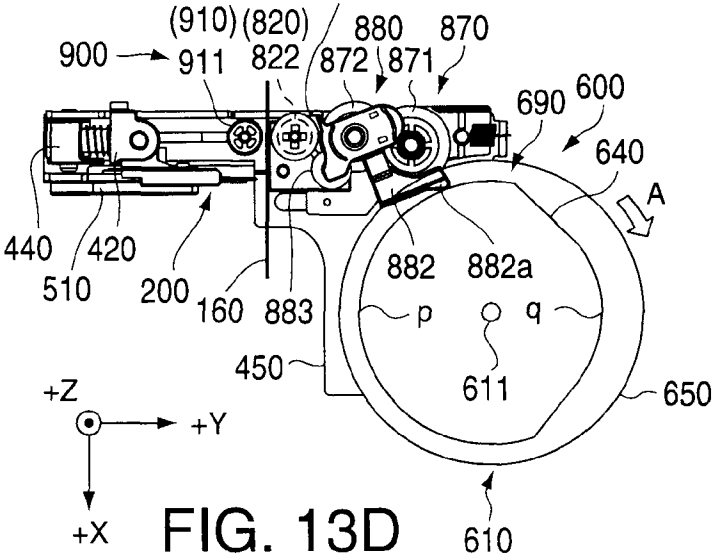
Figure 14C:
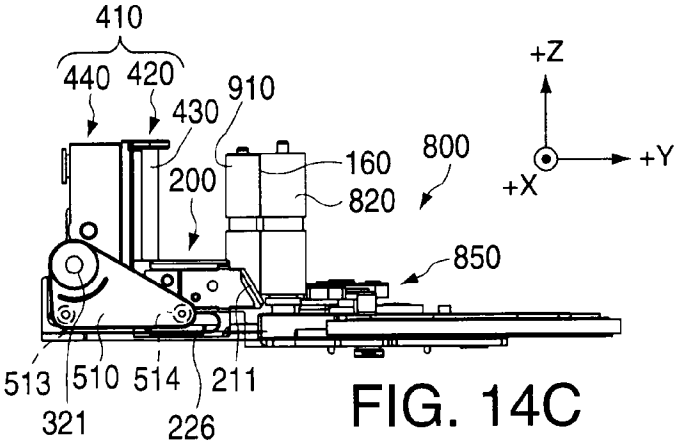
FIGS. 14A to 14D are operational illustrations of the cutting device at the full cutting time.
Figure 14D:
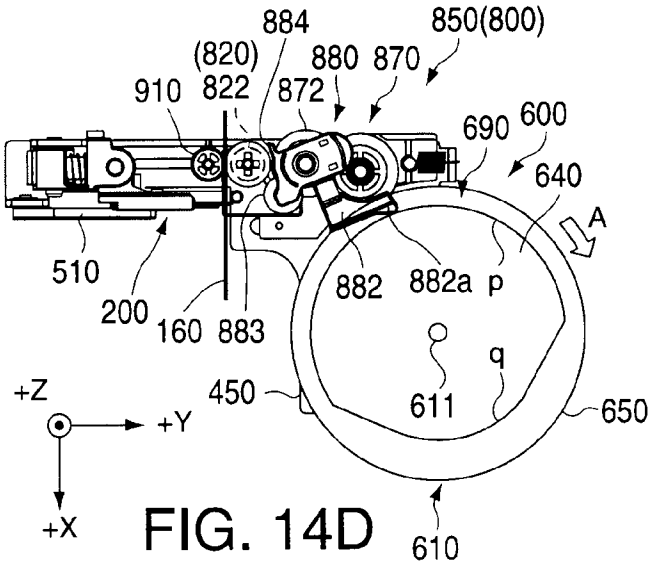
Figure 14A:
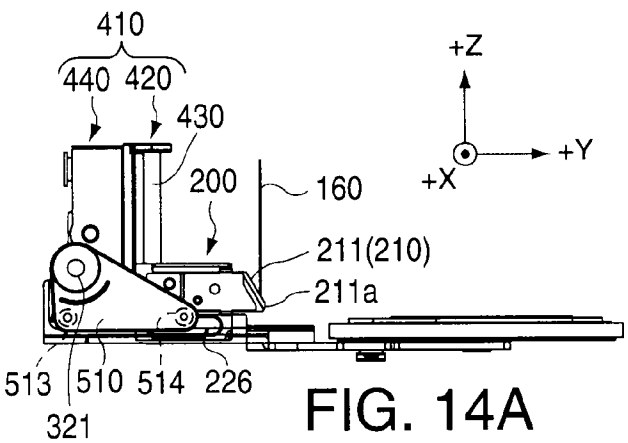
Figure 14B:
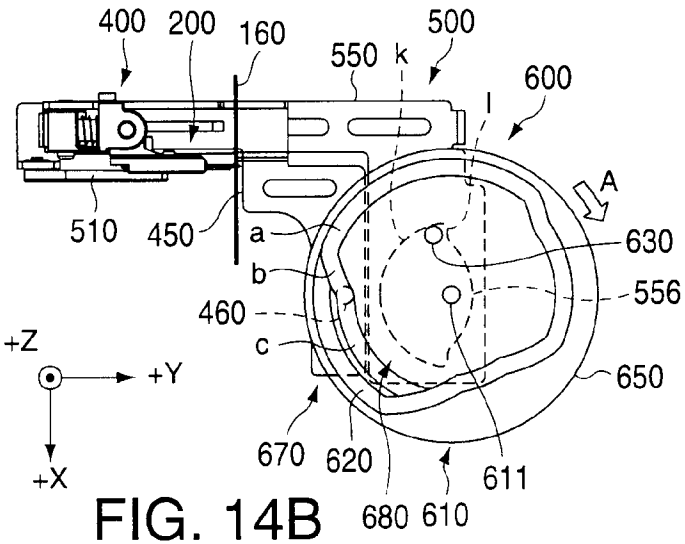
Figure 15C:
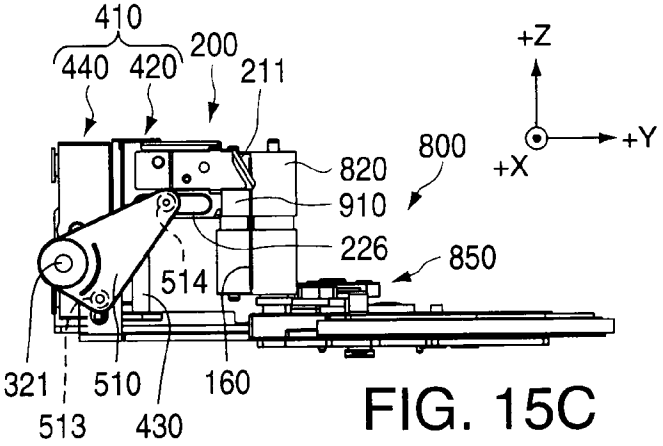
FIGS. 15A to 15D are operational illustrations of the cutting device at the full cutting time.
Figure 15D:
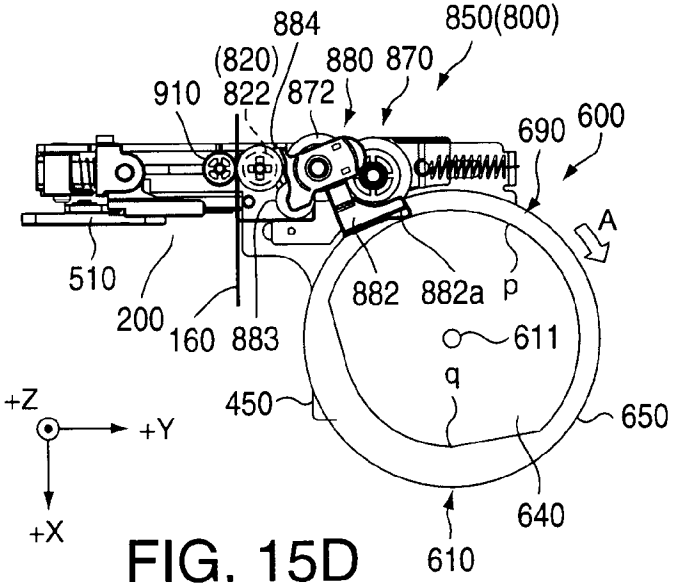
Figure 15A:
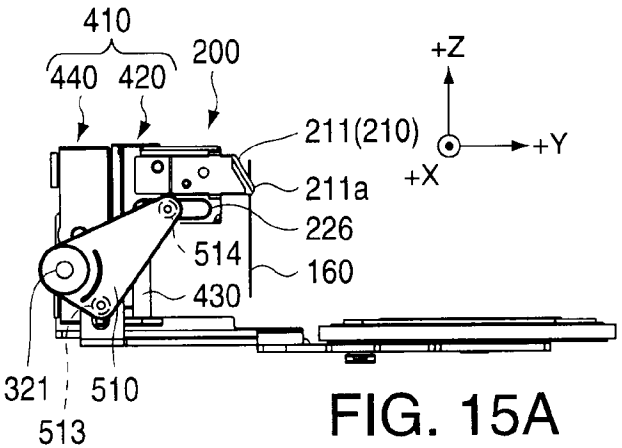
Figure 15B:
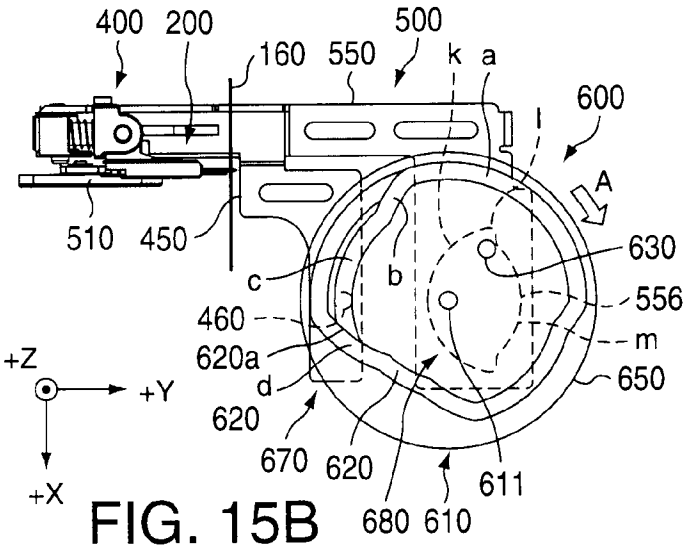

FIGS. 11A and 11B are perspective views of the rotating circular plate 610, where FIG. 11A is a perspective view of the rotating circular plate 610 seen from the top side, and FIG. 11B is a perspective view of the rotating circular plate 610 seen from the bottom side. FIGS. 12A to 12C are diagrams showing the rotating circular plate 610, where FIG. 12A is a plan view of the rotating circular plate 610, FIG. 12B is a F-F' sectional view of the planar cam groove 620, and FIG. 12C is a G-G' sectional view of the planar cam groove 620. FIG. 12A showing a plan view of the rotating circular plate 610 seen from the top side (+Z side), the planar cam groove 620 and crank projection 630, although formed and disposed on the bottom side of the rotating circular plate 610 in reality, are shown as a transparent diagram by the solid lines for convenience of description. Also, the cam projection 460 disposed on the lower side (−Z side) of the rotating circular plate 610 is shown by the solid line, and the crank hole 556 by the two-dot chain line. With reference to FIGS. 10, 11A and 11B, and 12A to 12C, a description will be given of a configuration and outline operation of the rotating circular plate 610.

As shown in FIGS. 10 and 11A, an edge cam projecting portion 640, acting as a raised cam projecting portion, of which one portion is formed in continuity so as to be the same in the distance from a rotating aperture 611 with the rotating aperture 611 as the center, and the other portion is formed in continuity so as to vary in the distance, is formed on the top of the rotating circular plate 610. The edge cam projecting portion 640 configures an engagement portion 615 of the rotating circular plate 610. The edge cam projecting portion 640 controls the operation (the rotation and the prohibition of the rotation) of the tape discharge roller 820. Also, an edge cam mechanism 690 acting as a cam mechanism is configured between the rotating circular plate 610 and discharge drive portion 850 by the edge cam projecting portion 640 and the clutch portion 880 driven in engagement (abutment) with a side surface (an edge cam) of the edge cam projecting portion 640. In other words, the edge cam mechanism 690 acting as the cam mechanism is configured between the discharge drive portion 850 of the tape discharge mechanism 800 and the rotating circular plate 610 by the edge cam projecting portion 640 of the rotating circular plate 610 and the clutch portion 880 engaging with the edge cam projecting portion 640.

As shown in FIGS. 7, 10, and 11A and 11B, the gear portion 650 configuring the engagement portion 615 of the rotating circular plate 610 is formed on the outer periphery of the rotating circular plate 610. Also, as heretofore described, the gear portion 650 engages (meshes) with the transmission gear 723 of the drive portion 700, and transmits the rotative force from the drive motor 710 to the rotating circular plate 610. Also, as shown in FIG. 10, the gear portion 650 transmits the rotative force of the rotating circular plate 610 to the clutch portion 880 (eventually to the tape discharge roller 820) by means of the transmission mechanism 660 engaging with the first gear 871 (transmission gear train 870) of the tape discharge mechanism 800, as heretofore described.

The discharge drive portion 850 (transmission gear train 870 and clutch portion 880), by means of the rotation of the rotating circular plate 610, brings the edge cam mechanism 690 and transmission mechanism 660 in conjunction, and causes them to carry out the rotation of the tape discharge roller 820. Alternatively, the discharge drive portion 850 causes them to prohibit the rotation (details will be described hereafter).

As shown in FIG. 11A, by a lever projecting portion 882*a* of the clutch lever 882 abutting against and sliding on the edge cam projecting portion 640 side surface (edge cam) formed the same distance from the rotating aperture 611 with the rotating aperture 611 as the center, the clutch portion 880 is driven to operate. Because of this, the gear stopper 884 engages with the roller rotating gear 822, shown in FIG. 10, of the tape discharge roller 820, thus prohibiting the rotation of the tape discharge roller 820.

As shown in FIGS. 11B and 12A, the planar cam groove 620 acting as a cam groove, of which the groove width is approximately constant, and the distance from the rotating aperture 611 is made different from one portion to another, is continuously formed in a ring form, with the rotating aperture 611 as the center, in the bottom of the rotating circular plate 610. The planar cam groove 620 configures the engagement portion 615 of the rotating circular plate 610. The cam projection 460 disposed on the first plate 450 engages with the planar cam groove 620. In FIG. 12A, the planar cam groove 620 is displayed by the dots. Also, as shown in FIGS. 11B and 12A, the crank projection 630 engaging with the crank hole 556 formed in the second plate 550 is projectingly disposed on the bottom of the rotating circular plate 610. The crank projection 630 is projectingly disposed inside the region surrounded by the planar cam groove 620 formed in a ring form. The crank projection 630 configures the engagement portion 615 of the rotating circular plate 610.

By means of the configurations of the first movement mechanism 400 and second movement mechanism 500, the cam projection 460 of the first plate 450 and the crank hole 556 of the second plate 550 are such that, when the rotating circular plate 610 rotates around the rotating aperture 611 (a support pin 314), the cam projection 460 slides in the Y axis direction along the planar cam groove 620. Also, by the crank projection 630 rotating along the shape of the crank hole 556, the crank hole 556 (second plate 550) slides in the Y axis direction.

In the embodiment, by causing the rotation direction of the rotating circular plate 610 to change, the half cutting or full cutting is carried out and, by causing the rotating circular plate 610 to turn around once (rotate once), the series of half cutting or full cutting operations (circulatory movement) is completed. The rotating circular plate 610 carries out the full cutting operation by means of the forward direction rotation (clockwise rotation) shown by an arrow A, and carries out the half cutting operation by means of the backward direction rotation (a counterclockwise rotation) shown by an arrow B.

The planar cam mechanism 670, being configured of the planar cam groove 620, cam projection 460 (first plate 450), and the like, as shown in FIGS. 12A to 12C, is a mechanism which converts the rotative force of the rotating circular plate 610 into a sliding motion of the first plate 450, and causes the first movement mechanism 400 (cutter unit 200) to slide in the Y axis direction. Also, the crank mechanism 680, being configured of the crank projection 630, crank hole 556 (second plate 550), swaying plate 510, and the like, is a mechanism which converts the rotative force of the rotating circular plate 610 into a sliding motion of the second plate 550, and causes the cutter unit 200 caused to slide by the planar cam mechanism 670 to slide in the Z axis direction. The planar cam mechanism 670 and crank mechanism 680 configure the power transmission mechanism 600.

Herein, the planar cam mechanism 670 and crank mechanism 680, by the rotating circular plate 610 turning around once, carries out the serial full cutting or half cutting circulatory movement. Also, the planar cam mechanism 670 and crank mechanism 680 are configured in such a way that the cutting stand-by positions (initial positions) at a full cutting time and a half cutting time coincide.

In the planar cam groove 620, when the rotating circular plate 610 rotates, when there is no change in the distance from the center (the center of the rotating aperture 611) of the rotating circular plate 610 to the cam groove, the current position (Y axis direction position) of the cutter unit 200 is maintained. Also, when the distance from the center of the rotating circular plate 610 to the cam groove gradually becomes shorter, the position of the cutter unit 200 is advanced (moved in the +Y direction). Also, when the distance from the center of the rotating circular plate 610 to the cam groove gradually becomes longer, the position of the cutter unit 200 is retreated (moved in the −Y direction). In FIGS. 12A to 12C, the reference characters of a section a to a section i are added to the channels of the planar cam groove 620 for each of the sections corresponding to the heretofore described changes in distance. The section a and section i have the same distance from the center of the rotating circular plate 610 to the cam groove.

The sections a, c, e, g, and i of the planar cam groove 620 are sections in which there is no change in distance, that is, sections in which the current position (Y axis direction position) of the cutter unit 200 is maintained. Also, the sections b, d, f, and h are sections in which the distance gradually becomes shorter or longer, that is, sections in which the position of the cutter unit 200 is advanced (moved in the +Y direction) or retreated (moved in the −Y direction), although this is reversed depending on the rotation direction.

Also, by making different the distance to the section c of the cam groove, and the distance to the section g of the cam groove, from the center of the rotating circular plate 610, a cutting start position at the full cutting time and a cutting start position at the half cutting time are made different. Also, by making different the distance to the section i of the cam groove, and the distance to the section g of the cam groove, from the center of the rotating circular plate 610, a withdrawal position at the half cutting time and a withdrawal position at the full cutting time are made different.

In the crank hole 556, when the rotating circular plate 610 is caused to rotate, and the crank projection 630 revolves (moves in a circle), when there is no change in the distance from the center of the rotating circular plate 610 (the center of the rotating aperture 611) to the crank hole 556, the current height position (z axis direction position) of the cutter unit 200 is maintained. Also, when the distance from the center of the rotating circular plate 610 to the crank hole 556 becomes shorter, the position of the cutter unit 200 is raised (moved in the +Z direction). Also, when the distance from the center of the rotating circular plate 610 to the crank hole 556 becomes longer, the position of the cutter unit 200 is lowered (moved in the −Z direction). In FIGS. 12A to 12C, the reference characters of a section k to a section n are added to the shapes of the crank hole 556 for each of the sections corresponding to the heretofore described changes in distance.

The sections k and m of the crank hole 556 are sections in which there is no change in distance, that is, sections in which the current height position of the cutter unit 200 is maintained. Also, the sections 1 and n are sections in which the distance becomes shorter or longer, that is, sections in which the position of the cutter unit 200 is raised (moved in the +Z direction) or lowered (moved in the −Z direction), although this is reversed depending on the rotation direction.

In the edge cam projecting portion 640, when the rotating circular plate 610 rotates, in a section (a section p) in which the distance from the center of the rotating circular plate 610 to the edge cam is longest, and there is no change, the edge cam abuts against the lever projecting portion 882*a* of the clutch lever 882, compulsorily causing the clutch portion 880 to rotate. Because of this, the gear stopper 884 meshes with the roller rotating gear 822, prohibiting the operation (rotation) of the tape discharge roller 820. Also, in a section (a section q) in which the distance from the center of the rotating circular plate 610 to the edge cam is shorter than in the section p, the edge cam is prevented from abutting against the lever projecting portion 882*a* of the clutch lever 882, and the clutch lever 882 is freed. In this condition, the clutch portion 880 carries out a rotation in a direction the same as the rotation direction of the second gear 872.

As shown in FIGS. 12A to 12C, the planar cam groove 620, in which cam grooves with differing channels are formed, is such that the cam grooves which form the differing channels are connected to each other by having stepped portions 620*a* and 620*b* in a groove depth direction. One (the section b and the section c) of the differing channels is a channel which is used by the cam projection 460 engaging therewith only when carrying out the full cutting. Particularly, the section b is a channel in which the cutter unit 200 is advanced in the +Y direction from the cutting stand-by position to the cutting start position in the cutting preparation operation, and the section c is a channel in which the Y axis direction position of the cutter unit 200 is maintained in the cutting operation. Also, the other (one portion of the section d and the section i) of the differing channels is a channel which is used by the cam projection 460 engaging therewith only when carrying out the half cutting. Particularly, one portion of the section d (a region connected to the section i) is a channel in which the cutter unit 200 is retreated in the −Y direction from the cutting completion position to the withdrawal position in the withdrawal operation, and the section i is a channel in which the Y axis direction position of the cutter unit 200 is maintained in the return operation.

The channel shown in the F-F' section shown in FIG. 12B is the channel used in the case of the full cutting, and the channel shown in the G-G' section shown in FIG. 12C is the channel used in the case of the half cutting. The cam projection 460 is shown for convenience of description.

As shown in FIG. 12B, in the case of the full cutting, the rotating circular plate 610 rotates in the direction of the arrow in the drawing with respect to the cam projection 460. Then, as the stepped portion 620*a* comes nearer to the cam projection 460, the groove depth decreases. In response to this change in the groove depth, the cam projection 460 is pressed and pushed down to the bottom side (underside) of the rotating circular plate 610. The cam projection 460 is pushed down to the fullest in the position of the stepped portion 620*a* and, immediately after having passed the stepped portion 620*a*, returns to a normal position by means of the pressing force of the pressing spring 471 of the projection holding portion 470. By means of this operation, the cam projection 460 can return to the common channel.

With regard to FIG. 12C too, only the rotation direction of the rotating circular plate 610 differing, the operation of the cam projection 460 with respect to the stepped portion 620*b* is the same as the heretofore described operation of the cam projection 460 with respect to the stepped portion 620*a*, so a description will be omitted. The rotating circular plate 610 is such that, as the traveling direction of the cam projection 460 is regulated by the stepped portions 620*a* and 620*b*, the cam projection 460 is prevented from entering a differing channel. Particularly, in the case of the full cutting, the traveling direction of the cam projection 460 is regulated by the stepped portion 620*b* while, in the case of the half cutting, the traveling direction of the cam projection 460 is regulated by the stepped portion 620*a*.

With reference to FIGS. 13A to 18D, a description will be given of an outline of the circulatory movement of the embodiment.

The circulatory movement of the embodiment includes the cutting preparation operation, cutting operation, withdrawal operation, and return operation. Then, the circulatory movement is carried out by branching power and transmitting it to the first movement mechanism 400 and second movement mechanism 500 by means of the power transmission mechanism 600, and causing the cutter unit 200, tape discharge mechanism 800, and tape pressing mechanism 900 to operate.

FIGS. 13A to 18D are diagrams for illustrating operations of the cutting device 20 in the order of the operations when full-cutting the tape-like member 160. Also, FIGS. 13A, 14A, 15A, 16A, 17A and 18A are main portion side views showing operations of the cutter unit 200 by the planar cam mechanism 670 and crank mechanism 680, FIGS. 13B, 14B, 15B, 16B, 17B, and 18B are main portion plan views of FIGS. 13A, 14A, 15A, 16A, 17A, and 18A, FIGS. 13C, 14C, 15C, 16C, 17C, and 18C are main portion side views showing operations of the tape discharge mechanism 800 and tape pressing mechanism 900 by the edge cam mechanism 690, and FIGS. 13D, 14D, 15D, 16D, 17D, and 18D are main portion plan views of FIGS. 13C, 14C, 15C, 16C, 17C, and 18C. For convenience of description, only the main portion is shown in each drawing.

Also, in FIGS. 13B, 14B, 15B, 16B, 17B, and 18B, for convenience of description, the planar cam groove 620 and crank projection 630 configured on the bottom of the rotating circular plate 610 are shown by the solid lines as transparent views. Also, when carrying out the full cutting, the rotating circular plate 610 carries out the forward direction rotation (clockwise rotation), as shown by an arrow A, by means of the operation of the drive portion 700.

The cutting preparation operation is an operation of causing the cutter unit 200 to advance toward the tape-like member 160 from the cutting stand-by position to the cutting start position. The advancement is carried out by causing the cutter unit 200 to move forward (move in the +Y direction).

The cutting stand-by position, being an initial position in a condition in which the cutting device 20 is out of operation, is a common initial position when carrying out the full cutting or half cutting. Also, in the embodiment, the cutting start position is made different between the case of carrying out the full cutting and the case of carrying out the half cutting. In other words, the cutting start position is made different in the distance from the cutting stand-by position between the case of carrying out the full cutting and the case of carrying out the half cutting.

Particularly, when carrying out the full cutting, the cutting start position is such that the blade edge 211, which is the inclined blade of the cutter blade 210 of the cutter unit 200, is set in a position in which both the printing tape 161 and release paper 162 are cut. Also, when carrying out the half cutting, the cutting start position is such that a cutting point 211*a* of the blade edge 211 of the cutter blade 210 is set in a position in which only the printing tape 161 is cut.

Because of this, it is possible, by means of the cutting operation, to be described hereafter, to change the amount by which the cutter unit 200 (cutter blade 210) cuts into the tape-like member 160. For this reason, when the full cutting is carried out, it is possible to completely cut off the tape-like member 160. Also, when the half cutting is carried out, it is possible to completely cut only the printing tape 161 in a condition in which the release paper 162 remains connected.

The cutting operation is an operation of causing the cutter unit 200 to move from the cutting start position to the cutting completion position and, by means of this operation, the cutter unit 200 cuts the tape-like member 160. In the embodiment, the cutting operation is configured of a first cutting operation and a second cutting operation. The first cutting operation is an operation of carrying out a cutting by moving (raising) the cutter unit 200 in the width direction from the cutting start position to a predetermined position. Also, the second cutting operation is an operation of carrying out a cutting by moving (advancing) the cutter unit 200 in a direction approximately perpendicular to the tape surface of the tape-like member 160 from the predetermined position to the cutting completion position.

The withdrawal operation is an operation of retreating the cutter unit 200 from the cutting completion position to the withdrawal position. The retreat is carried out by causing the cutter unit 200 to move backward (move in the −Y direction). In the embodiment, the withdrawal position is made different between the case of carrying out the full cutting and the case of carrying out the half cutting. In other words, the withdrawal position is made different in the distance from the cutting completion position between the case of carrying out the full cutting and the case of carrying out the half cutting. Particularly, when carrying out the full cutting, the withdrawal position is set in a position in which the cutting point 211*a* of the cutter blade 210 is aligned touching the tape-like member 160.

Also, when carrying out the half cutting, the withdrawal position is set to a position in which the cutting point 211*a* of the cutter blade 210 is away from the tape surface (a surface of the printing tape 161 of the tape-like member 160 on the side to which the ink of the ink ribbon 170 is thermally transferred) of the tape-like member 160. Then, in the embodiment, the withdrawal position at the half cutting time is set in such a way as to be positioned above the cutting stand-by position (in the +Z direction).

The return operation is an operation of causing the cutter unit 200 to return from the withdrawal position to the cutting stand-by position. The return is such that, as the withdrawal position differs between the full cutting time and half cutting time, the channel as far as the cutting stand-by position differs therebetween. Particularly, at the full cutting time, firstly, the cutter unit 200 is lowered (moved in the −Z direction) from the withdrawal position, and subsequently, moved backward (moved in the −Y direction), thereby returning the cutter unit 200 to the cutting stand-by position (initial position). Also, at the half cutting time, simply by the cutter unit 200 being lowered (moved in the −Z direction) from the withdrawal position, it is possible to return the cutter unit 200 to the cutting stand-by position (initial position). The circulatory movement is carried out in the way heretofore described.

Herein, a description will be given of operations of the tape discharge mechanism 800 and tape pressing mechanism 900 when carrying out the full cutting and half cutting in the circulatory movement.

In the cutting preparation operation, when carrying out the full cutting and half cutting, the tape discharge mechanism 800 prohibits the rotation of the tape discharge roller 820. Also, the tape pressing mechanism 900 is driven by an operation of the cutter unit 200 advancing toward the tape-like member 160 from the cutting stand-by position to the cutting start position, and advances in the same way. Consequently, the tape pressing roller 910 advances toward the tape discharge roller 820. Then, when the cutter unit 200 is positioned in the cutting start position, the tape pressing mechanism 900 causes the tape pressing roller 910 to press the tape-like member 160 with the tape discharge roller 820. By means of this operation, the tape pressing mechanism 900 attains a condition in which the tape-like member 160 disposed between the tape discharge roller 820 and tape pressing roller 910 is pressed and clamped by the tape discharge roller 820 and tape pressing roller 910.

In the cutting operation, when carrying out the full cutting and half cutting, the tape discharge mechanism 800 maintains the condition in which it prohibits the rotation of the tape discharge roller 820. Also, the tape pressing mechanism 900 maintains the condition in which it clamps the tape-like member 160 by means of the tape pressing roller 910 and tape discharge roller 820.

In the withdrawal operation, when carrying out the full cutting, the tape discharge mechanism 800 causes the tape discharge roller 820 to rotate in a direction in which it discharges the tape-like member 160. Also, the tape pressing mechanism 900 maintains the condition in which it clamps the tape-like member 160 by means of the tape pressing roller 910 and tape discharge roller 820. Consequently, the tape pressing roller 910 is driven by the rotation of the tape discharge roller 820 to carry out the rotation in the direction in which it discharges the tape-like member 160. The withdrawal operation is an operation after the cutting operation finishes.

In the withdrawal operation, when carrying out the half cutting, the tape discharge mechanism 800 prohibits the rotation of the tape discharge roller 820. Also, the tape pressing mechanism 900 retreats by being driven by an operation of the cutter unit 200 retreating from the cutting completion position to the withdrawal position. Consequently, by the tape pressing roller 910 retreating from the tape discharge roller 820, the tape-like member 160 is released from the condition in which it is pressed and clamped.

In the return operation, when carrying out the full cutting, the tape discharge mechanism 800 and tape pressing mechanism 900 maintain the condition in the withdrawal operation until the cutter unit 200 is positioned in the cutting stand-by position. Consequently, the tape pressing roller 910 is driven by the rotation of the tape discharge roller 820 to carry out the rotation in the direction in which it discharges the tape-like member 160.

In the return operation, when carrying out the half cutting, the tape discharge mechanism 800 and tape pressing mechanism 900 maintain the condition in the withdrawal operation until the cutter unit 200 is positioned in the cutting stand-by position. Consequently, the tape discharge roller 820 is prohibited from rotating, the tape pressing roller 910 attains a condition in which it is away from the tape discharge roller 820, and the tape-like member 160 maintains the condition in which it is released from being pressed and clamped.

As heretofore described, in the circulatory movement, the tape discharge mechanism 800 and tape pressing mechanism 900 carry out the operations in conjunction.

In the cutting preparation operation and cutting operation when carrying out the full cutting and half cutting, the rotation of the tape discharge roller 820 is prohibited, and the tape pressing roller 910 and tape discharge roller 820 attain the condition in which they clamp the tape-like member 160. Because of this, it is possible to prevent the tape-like member 160 from being drawn out from the tape ejection slot 104 of the tape printing apparatus 1. Also, when the full cutting is carried out, in the withdrawal operation and return operation which are operations after the cutting operation finishes, by the tape discharge roller 820 rotating, and the tape discharge roller 820 rotating with the tape-like member 160 clamped by the tape pressing roller 910 and tape discharge roller 820, it is possible to discharge the cut and separated tape-like member 160 from the tape ejection slot 104.

With reference to FIGS. 13A to 18D, a description will be given of an operation of the cutting device 20 when full-cutting the tape-like member 160.

The diagrams shown in FIGS. 13A to 13D show a condition in which the cutter unit 200 is positioned in the cutting stand-by position (initial position). At the half cutting time too, the cutting stand-by position is the same position. In this condition, the cam projection 460 is positioned in the section a of the planar cam groove 620, and the first plate 450 is farthest away from the tape-like member 160 in the −Y direction. Consequently, the cutter unit 200 is also farthest away from the tape-like member 160 in the −Y direction. The tape pressing roller 910 driven by this movement of the first plate 450 is also farthest away from the tape discharge roller 820 in the −Y direction. Also, the crank projection 630 is positioned in the section k of the crank hole 556, and the cutter unit 200 comes to a position lowest in the −Z direction along the guide shaft 430.

The clutch lever 882, as it rotates in a direction the same as the rotation of the second gear 872 of the discharge drive portion 850, carries out the rotation in the forward direction the same as the rotation direction of the rotating circular plate 610 at the full cutting time. However, the clutch lever 882, by being pressed by the edge cam projecting portion 640 which is the section p, is placed in a condition in which the rotation is reversed and returned to the opposite side. Consequently, the clutch lever 882, by being positioned in the section p of the edge cam projecting portion 640, prohibits the rotation of the tape discharge roller 820. In this condition, the tape-like member 160 is in the condition in which it is released from the condition in which it is pressed by the tape discharge roller 820 and tape pressing roller 910.

The diagrams shown in FIGS. 14A to 14D show a condition in which the cutter unit 200 advances from the cutting stand-by position, and is positioned in the cutting start position (the cutting preparation operation is completed). In this condition, the cam projection 460 passes the section a of the planar cam groove 620, enters the section b, and is positioned on the boundary with the section c. When the cam projection 460 passes the section a and enters the section b, its traveling direction is regulated by the stepped surface of the stepped portion 620*b* connecting the section i and section a, and the cam projection 460 enters the section b along the stepped surface.

While the cam projection 460 is passing the section a of the planar cam groove 620, the cutter unit 200 is positioned in the cutting stand-by position in the same way as in the condition of FIGS. 13A to 13D. Then, at the same time as the cam projection 460 enters the section b, the cutter unit 200 starts to advance (move in the +Y direction) toward the tape-like member 160 from the cutting stand-by position. Then, the cam projection 460, when positioned at the termination of the section b (on the boundary with the section c), stops advancing. This position is the cutting start position. In this condition, the cutting point 211*a* of the blade edge 211 of the cutter blade 210 is positioned farther in the +Y direction than the position of the tape-like member 160. Consequently, the blade edge 211 portion (inclined blade portion) of the cutter blade 210 is positioned on the lower side of the tape-like member 160. In this way, the cutting preparation operation is carried out by means of the operation of the first movement mechanism 400.

The tape pressing roller 910 is driven by this to attain a condition in which it presses against the tape discharge roller 820 across the tape-like member 160, and the tape-like member 160 is clamped by the tape discharge roller 820 and tape pressing roller 910. The crank projection 630 is positioned in the section k of the crank hole 556, and the cutter unit 200 maintains a position lowest in the −Z direction along the guide shaft 430 in the same way as shown in FIGS. 13A to 13D. Also, as the clutch lever 882 is positioned in the section p of the edge cam projecting portion 640, the tape discharge roller 820 is prohibited from rotating in the same way as shown in FIGS. 13A to 13D.

Subsequently, by the rotating circular plate 610 rotating, the full cutting operation (first cutting operation) is started.

Particularly, the cam projection 460 is positioned in the section c of the planar cam groove 620, and maintains the Y axis direction position (the same position as the cutting start position) of the cutter unit 200. Also, the crank projection 630 is positioned in the section 1 of the crank hole 556, and starts to press it in the +Y direction, and the second plate 550 also starts to move in the same way.

By means of this operation, the first sliding shaft 513 of the swaying plate 510 pivotably held to the second plate 550 is also driven to move in the +Y direction. As the swaying plate 510 pivots around a support pin 321 of the base frame 310, by means of the +Y direction rotation of the second plate 550, the second sliding shaft 514 of the swaying plate 510, as well as pressing a sliding slot 226 of the cutter unit 200 upward, moves inside the sliding slot 226.

By means of the operation of the swaying plate 510, the cutter unit 200 moves upward (rises in the +Z direction) along the guide shaft 430. By means of the operation of the cutter unit 200, the cutter blade 210 (blade edge 211) starts the full cutting of the tape-like member 160. In this way, the cutting operation (first cutting operation) is started by the operation of the second movement mechanism 500. At this time, the tape discharge roller 820, being prohibited from rotating, maintains the condition in which it clamps the tape-like member 160 together with the tape pressing roller 910.

When cutting the tape-like member 160, the downstream side (−X direction) of the tape-like member 160 is clamped by the tape discharge roller 820 and tape pressing roller 910. Also, the upstream side (+X direction) of the tape-like member 160 is clamped by the platen roller 180 of the tape cartridge 15 and the printing head 131 of the printing head unit 130. In this condition, the cutter unit 200 (cutter blade 210), as well as moving in the width direction (+Z direction) of the tape-like member 160 and cutting the tape-like member 160, cuts it in a direction approximately perpendicular to the tape surface. Also, when the cutter blade 210 carries out a cutting, as the tape-like member 160 is cut pressed against the tape receiving surface 843*a* (refer to FIG. 9), it is possible to carry out a stable cutting.

The diagrams shown in FIGS. 15A to 15D show a condition in which the cutter unit 200 is most raised. This condition shows a condition in which the cutter unit 200 is moved from the cutting start position to the predetermined position, and the first cutting operation at the full cutting time is completed. In the condition in which the first cutting operation is completed, the tape-like member 160 is in a condition in which the upper portion thereof is not cut (uncut).

In this condition, the cam projection 460 is positioned at the termination of the section c of the planar cam groove 620. Because of this, the cam projection 460, being in a condition in which it maintains the Y axis direction position of the cutter unit 200, is maintaining the same position as the cutting start position. Also, the crank projection 630 is positioned on the boundary between the section 1 and section m of the crank hole 556, and attains a condition in which the crank hole 556 is moved farthest in the +Y direction. The swaying plate 510 is driven by this movement of the crank hole 556 (second plate 550) to operate, and the cutter unit 200 comes to the position (the predetermined position in the embodiment) in which it is most raised along the guide shaft 430.

At this time, the tape discharge roller 820 is prohibited from rotating in the same way as shown in FIGS. 14A to 14D, and is maintaining the condition in which it clamps the tape-like member 160 together with the tape pressing roller 910.

The diagrams shown in FIGS. 16A to 16D show a condition in which the cutter unit 200 moves from the predetermined position to the cutting completion position, and the second cutting operation at the full cutting time is completed. By carrying out the second cutting operation, the cutter unit 200 is advanced (moved in the +Y direction) from the predetermined position, causing the cutter unit 200 to cut the uncut portion of the upper portion of the tape-like member 160 utilizing the inclined portion of the blade edge 211 of the cutter blade 210, rather than raising the cutter unit 200. Also, the position of the cutter blade 210 in this condition is the cutting completion position. At the half cutting time too, the cutting completion position is the same position.

Figure 16C:
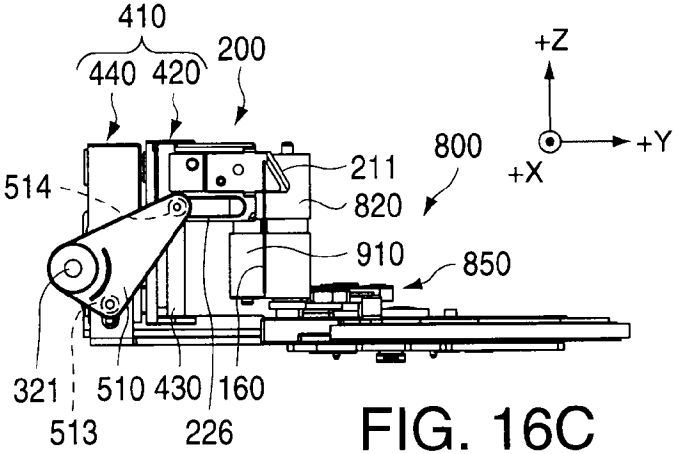
FIGS. 16A to 16D are operational illustrations of the cutting device at the full cutting time.
Figure 16D:
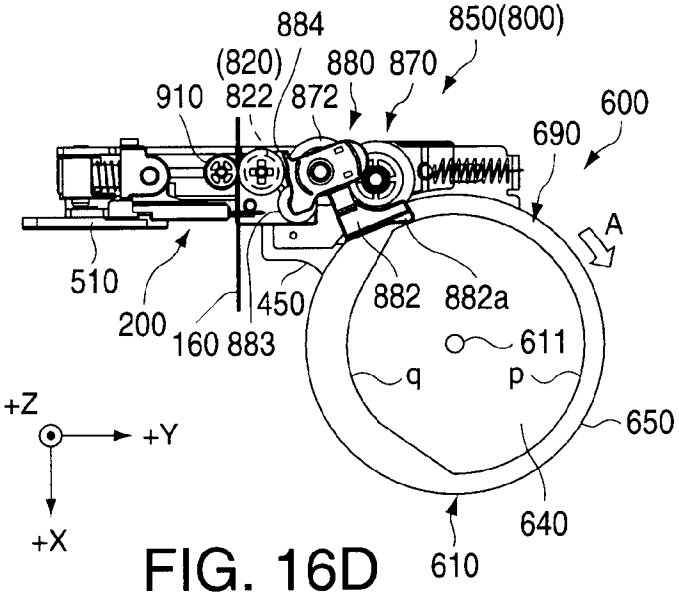
Figure 16A:
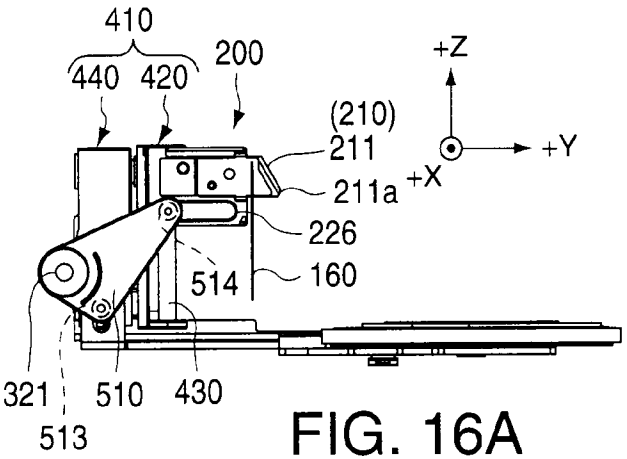
Figure 16B:
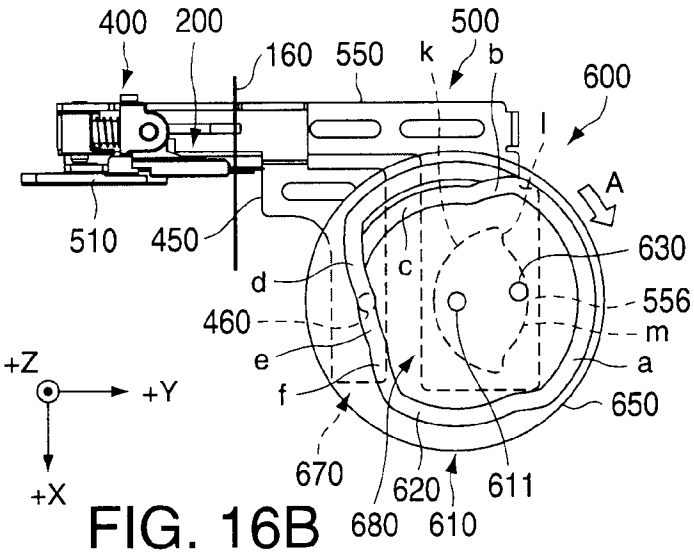
Figure 17C:
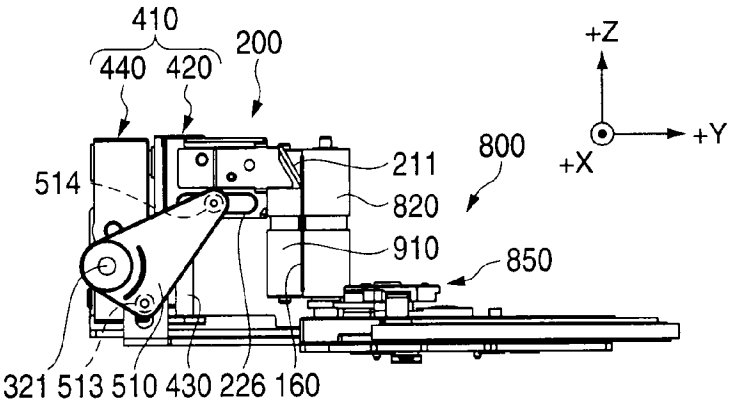
FIGS. 17A to 17D are operational illustrations of the cutting device at the full cutting time.
Figure 17D:
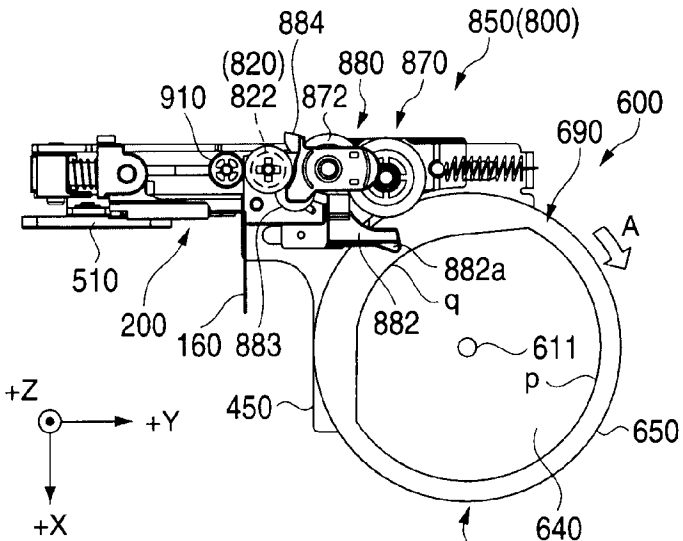
Figure 17A:
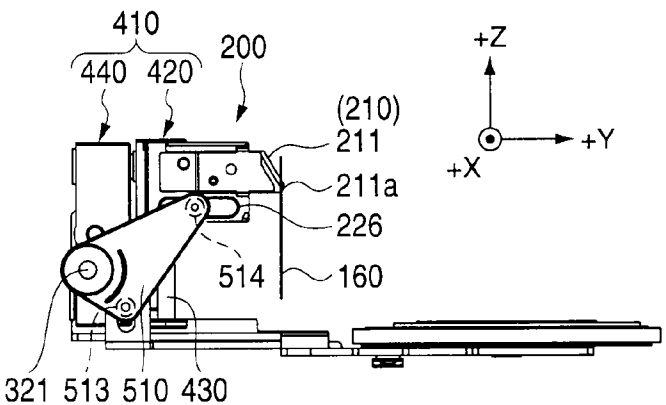
Figure 17B:
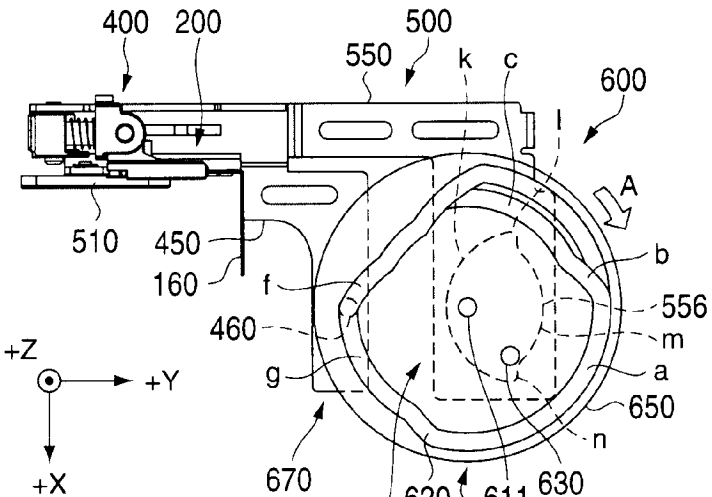
Figure 18C:
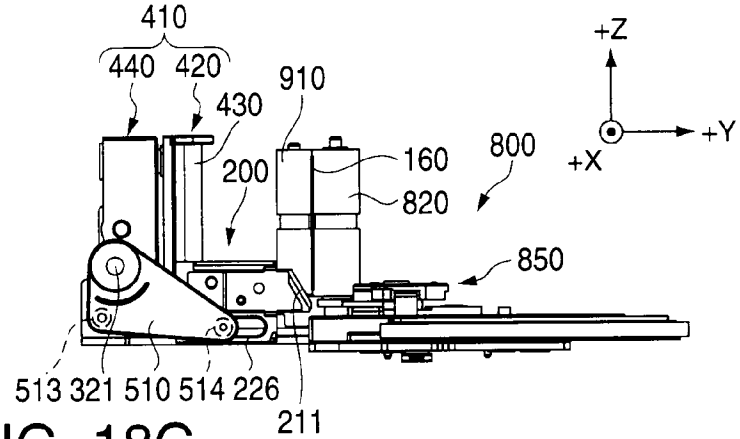
FIGS. 18A to 18D are operational illustrations of the cutting device at the full cutting time.
Figure 18D:
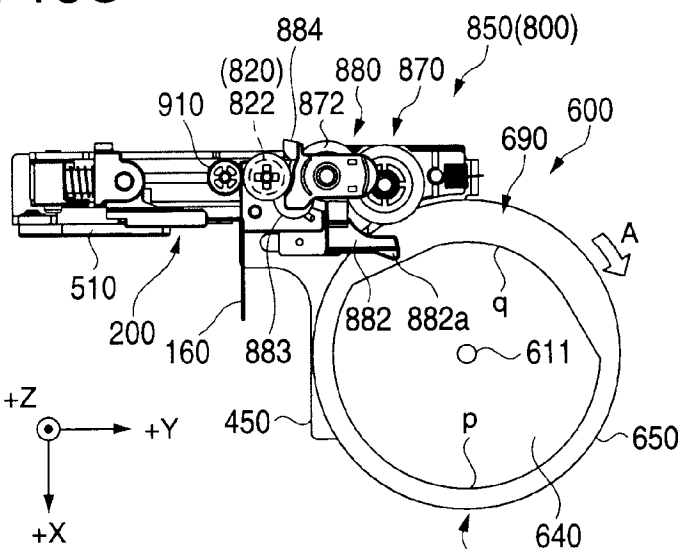
Figure 18A:
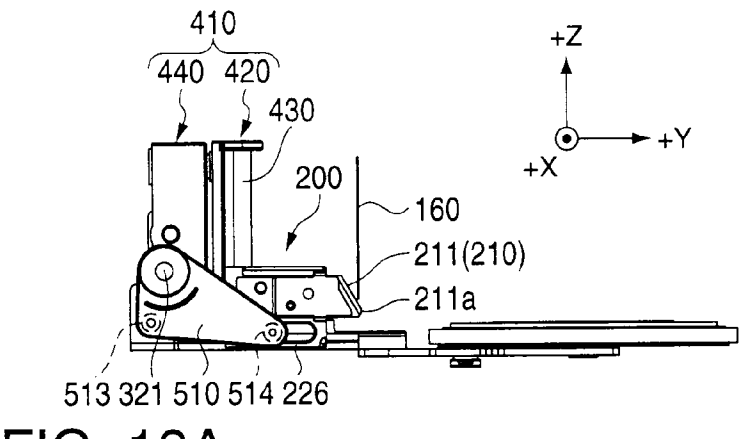
Figure 18B:
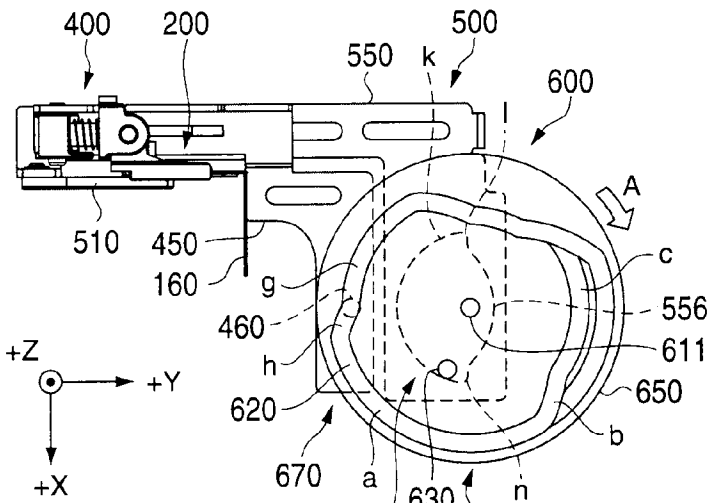
Figure 19A:
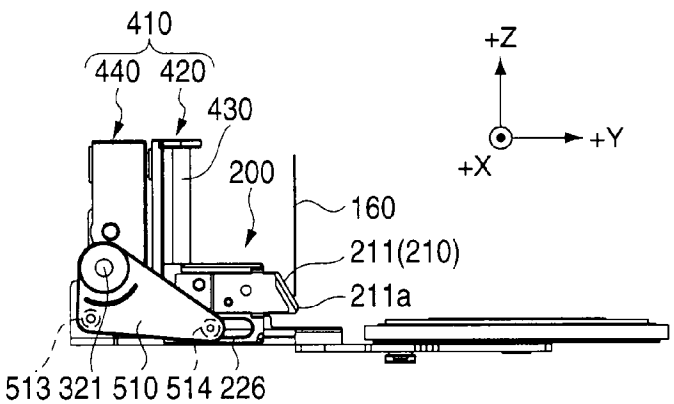
FIGS. 19A to 19D are operational illustrations of the cutting device at a half cutting time.
Figure 19B:
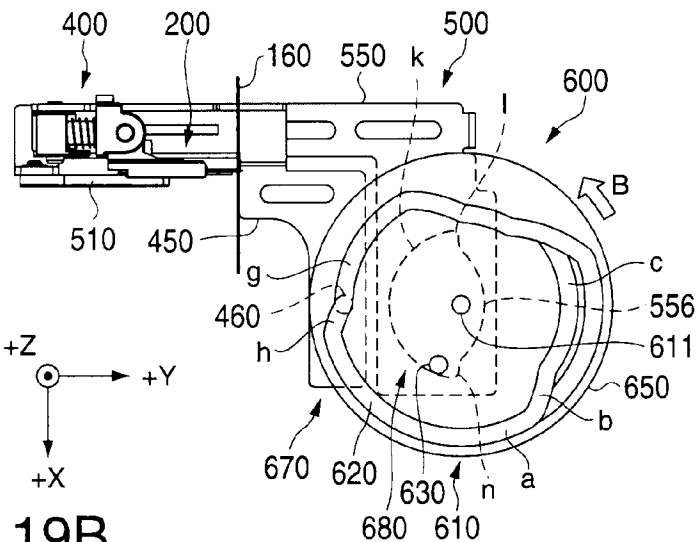
Figure 19C:
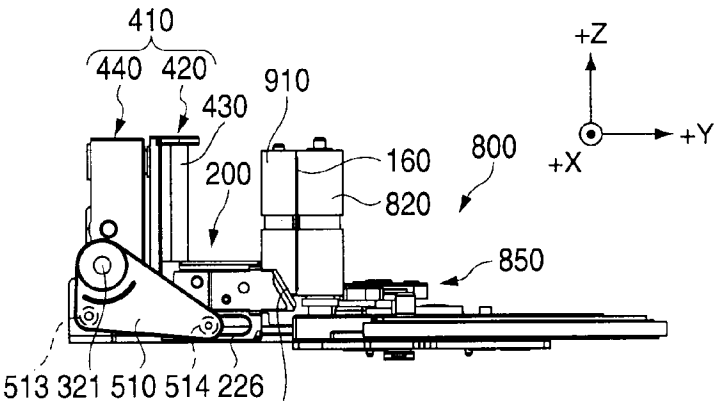
Figure 19D:
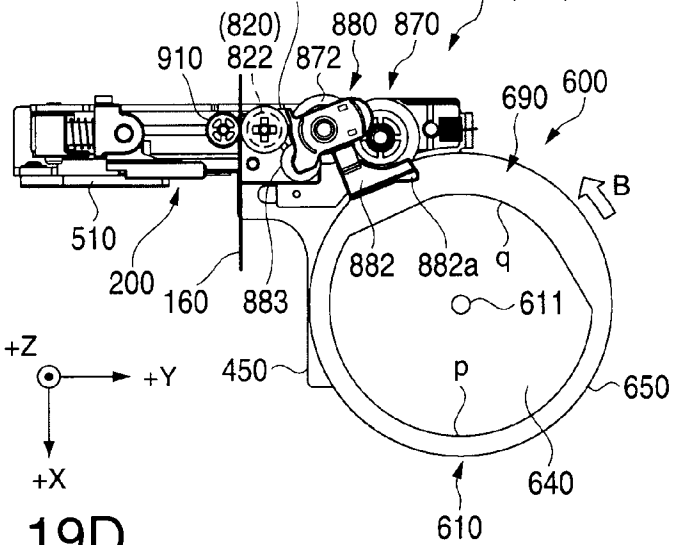

A description will be given of an operation until this condition is attained. After the cam projection 460 has passed the stepped portion 620*a* of the planar cam groove 620 from the condition shown in FIGS. 15A to 15D (the condition in which the cam projection 460 is in the section c of the planar cam groove 620), and entered the section d, the cutter unit 200 starts to advance (starts the second cutting operation). Then, the cutter unit 200 stops advancing (completes the second cutting operation) in the boundary position between the sections d and e of the planar cam groove 620. In this condition, as shown in FIG. 16A, the blade edge 211 of the cutter unit 200 (cutter blade 210) is moved farther in the +Y direction than the tape-like member 160. In this way, the cutting operation (second cutting operation) is carried out by means of the operation of the first movement mechanism 400.

In this condition, the crank projection 630, as it is positioned in the section m of the crank hole 556, is maintaining the Z direction position of the cutter unit 200. Also, in the same way as shown in FIGS. 14A to 14D, the tape discharge roller 820, being prohibited from rotating, is maintaining the condition in which it clamps the tape-like member 160 together with the tape pressing roller 910.

By carrying out a cutting by causing the cutter unit 200 to advance (move in the +Y direction), it is possible to reduce the movement distance in the up-down direction (the width direction of the tape-like member 160) of the cutter unit 200, and it is possible to miniaturize the cutting device 20.

The cutter blade clearance portion 832 (refer to FIG. 9) included in the tape discharge casing 830 is formed so as to correspond to the trajectory along which the blade edge 211 of the cutter unit 200 (cutter blade 210) moves from the cutting start position to the cutting completion position. Then, the blade edge 211 moves inside the cutter blade clearance portion 832 during the cutting operation.

Subsequently, by the rotating circular plate 610 rotating, the cutter unit 200 starts to retreat from the cutting completion position to the withdrawal position (the withdrawal operation starts).

Particularly, the cam projection 460 moves from the section e to the section f of the planar cam groove 620, causing the Y axis direction position of the cutter unit 200 in the cutting completion position to move (retreat) in the −Y direction. Also, the crank projection 630 is positioned in the section m of the crank hole 556, and maintains the Z axis direction position of the cutter unit 200 in the cutting completion position.

By the clutch lever 882 moving from the section p to the section q of the edge cam projecting portion 640, the lever projection 882*a* is prevented from abutting against the edge cam, and the clutch lever 882 is freed. In this condition, the clutch portion 880 carries out a rotation in a direction the same as the rotation direction of the second gear 872. As the second gear 872 is carrying out the forward direction rotation (clockwise direction) in the same way as the rotating circular plate 610, the clutch portion 880 rotates in the forward direction. By means of this rotation of the clutch portion 880, the clutch gear portion 883 of the clutch portion 880 meshes with the roller rotating gear 822.

Normally, as the clutch gear portion 883 is in mesh with the transmission gear 872*a* of the second gear 872, the rotative force of the second gear 872 is transmitted, rotating the clutch gear portion 883. By the clutch gear portion 883 meshing with the roller rotating gear 822, the rotative force of the clutch gear portion 883 is transmitted to the roller rotating gear 822, and the tape discharge roller 820 starts to rotate. The rotation direction of the tape discharge roller 820 is a rotation direction opposite the forward direction. That is, the rotation direction of the tape discharge roller 820 is such that the tape discharge roller 820 carries out the rotation which feeds the tape-like member 160 toward the direction of the tape ejection slot 104 of the tape printing apparatus 1.

Also, the tape discharge roller 820 clamps the tape-like member 160 together with the tape pressing roller 910. Also, portions of the tape pressing roller 910 and tape discharge roller 820 outside the width of the tape-like member 160 press directly against each other. For this reason, when the tape discharge roller 820 rotates, causing the tape-like member 160 to move toward the tape ejection slot 104, the tape pressing roller 910 is also driven to rotate. By means of this operation, the cut and separated tape-like member 160 reliably moves toward the tape ejection slot 104 without slipping. The tape discharge mechanism 800 causes the tape-like member 160 full-cut and separated by means of the operation of the edge cam mechanism 690 to be discharged from the tape ejection slot 104 by means of the rotation of the tape discharge roller 820.

The diagrams shown in FIGS. 17A to 17D show a condition in which the cutter unit 200 is moved from the cutting completion position to the withdrawal position (the withdrawal operation is completed). Also, the position of the cutter blade 210 at this time is the withdrawal position. In this condition, the cam projection 460 is positioned on the boundary between the section f and section g of the planar cam groove 620. The cam projection 460, by passing the section f of the planar cam groove 620, causes the Y axis direction position of the cutter unit 200 to move (retreat) in the −Y direction. Then, by the cam projection 460 being positioned on the boundary between the section f and section g of the planar cam groove 620, the cutter unit 200 finishes moving (retreating) in the −Y direction, and comes into the withdrawal position. In this way, the withdrawal operation is carried out by means of the operation of the first movement mechanism 400. The Y axis direction position in the withdrawal position is the same as the Y axis direction position in the cutting start position when the half cutting is carried out.

Also, the crank projection 630, as it is positioned at the termination of the section m of the crank hole 556, is maintaining the Z axis direction position of the cutter unit 200 in the cutting completion position. Also, as the clutch lever 882 is positioned in the section q of the edge cam projecting portion 640, a condition is such that the clutch gear portion 883 is in mesh with the roller rotating gear 822, and the tape discharge roller 820 keeps rotating. Also, the tape pressing roller 910 is maintaining the condition in which it clamps the tape-like member 160 together with the tape discharge roller 820.

When in this condition, the cutting point 211*a* of the cutter blade 210 is aligned touching the tape-like member 160. However, as the tape-like member 160 cut by the full cutting being completed is discharged from the tape discharge slit 104, it does not happen that the cutter blade 210 causes a defect to occur in the cut tape-like member 160.

Subsequently, by the rotating circular plate 610 rotating, the cutter unit 200 returns from the withdrawal position to the cutting stand-by position, so the cutter unit 200 starts to lower.

Particularly, the cam projection 460 moves in the section g of the planar cam groove 620. For this reason, the cutter unit 200 maintains the Y axis direction position in the withdrawal position. The crank projection 630 is positioned in the section n of the crank hole 556, and the crank hole 556 (second plate 550) starts to move in the −Y direction. By means of this operation, the first sliding shaft 513 of the swaying plate 510 rotatably held to the second plate 550 is also driven to move in the −Y direction.

At this time, as the swaying plate 510 pivots around the support pin 321 of the first plate 450, by means of the movement in the −Y direction of the second plate 550, the second sliding shaft 514 of the swaying plate 510, as well as pressing the sliding slot 226 of the cutter unit 200 downward, moves inside the sliding slot 226. By means of this operation of the swaying plate 510, the cutter unit 200 starts to move downward (lower in the −Z direction) along the guide shaft 430. In this way, the return operation in the Z axis direction is started by means of the operation of the second movement mechanism 500.

Also, as the clutch lever 882 is positioned in the section q of the edge cam projecting portion 640, the clutch gear portion 883 is in mesh with the roller rotating gear 822, and the tape discharge roller 820 keeps rotating. Also, the tape pressing roller 910 is maintaining the condition in which it clamps the tape-like member 160 together with the tape discharge roller 820.

The diagrams shown in FIGS. 18A to 18D show a condition in which the cutter unit 200 lowers most from the withdrawal position, and the cutter unit 200 starts to move to the cutting stand-by position. In this condition, the cutter unit 200 is in a condition in which it is partway through the return operation. In this condition, the cam projection 460 is positioned on the boundary between the section g and section h of the planar cam groove 620. For this reason, the cutter unit 200 is maintaining the Y axis direction position in the withdrawal position. Then, on the cam projection 460 entering the section h of the planar cam groove 620, the cutter unit 200 starts to move in the −Y direction toward the cutting stand-by position. In this way, the return operation in the Y axis direction is carried out by means of the operation of the first movement mechanism 400.

The crank projection 630 is positioned in the section k of the crank hole 556. For this reason, the cutter unit 200 is maintaining the Y direction position in the withdrawal position, and maintains a position in which it is lowered most in the Z axis direction. Also, as the clutch lever 882 is positioned in the section q of the edge cam projecting portion 640, the clutch gear portion 883 is in mesh with the roller rotating gear 822, and the tape discharge roller 820 keeps rotating. Also, the tape pressing roller 910 is clamping the tape-like member 160 together with the tape discharge roller 820.

Subsequently, by the rotating circular plate 610 rotating, the cutter unit 200 returns from the withdrawal position to the cutting stand-by position shown in FIGS. 13A to 13D.

A description will be given of the return operation as far as the cutting stand-by position. By the cam projection 460 passing the section h of the planar cam groove 620, the cutter unit 200 carries out a movement in the −Y direction. The crank projection 630 moves in the section k of the crank hole 556, and the cutter unit 200 is maintaining the Z axis direction position in the cutting stand-by position in which it is lowered most from the withdrawal position. The tape pressing roller 910 is also driven by this operation to carry out a movement in the −Y direction, and comes out of contact with the tape discharge roller 820.

In this condition, the clutch lever 882 moves through a portion of the shape which connects from the section q to the section p of the edge cam projecting portion 640, and the clutch gear portion 883 starts to be brought into abutment with and pressed by the edge cam projecting portion 640. For this reason, the clutch gear portion 883, in a condition in which it loosens the mesh with the roller rotating gear 822, gradually attains a condition in which it meshes with the gear stopper 884 (a condition in which it prohibits the rotation of the tape discharge roller 820).

Then, the rotating circular plate 610 turns around once, and the cam projection 460 attains the same condition as the condition shown in FIGS. 13A to 13D. Also, when this condition is attained, the detection switch portion 730 (refer to FIG. 7) disposed on the base frame 310 detects that the cutter blade 210 has been positioned in the cutting stand-by position (initial position), and outputs to the controller (not shown) the fact that the circulatory movement has finished. In response to this detection signal, the controller stops the drive of the drive portion 700 (drive motor 710) disposed on the base frame 310.

The cutter operation mechanism 300, by means of the drive (the rotation of the rotating circular plate 610) of the power transmission mechanism 600, branches power and transmits it to the first movement mechanism 400 and second movement mechanism 500, and brings the first movement mechanism 400 and second movement mechanism 500 into conjunction, causing the cutter unit 200 to carry out the circulatory movement for carrying out the full cutting. Also, the cutter operation mechanism 300, by means of the operation of the power transmission mechanism 600, carries out the series of operations of the tape discharge mechanism 800 and tape pressing mechanism 900 by bringing them into conjunction, as well as into synchronization, with the circulatory movement.

The tape printing apparatus 1, when the full cutting operation finishes, can start a next printing. When the tape printing apparatus 1 starts the next printing, the cutter unit 200 (the cutting edge 211 of the cutter blade 210), as it is in the cutting stand-by position and away from the tape-like member 160, does not impede the tape-like member 160 being fed for the printing.

FIGS. 19A to 22D are diagrams illustrating an operation of the cutting device 20 when half-cutting the tape-like member 160. Also, FIGS. 19A, 20A, 21A, and 22A are main portion side views showing an operation of the cutter unit 200 by the planar cam mechanism 670 and crank mechanism 680, FIGS. 19B, 20B, 21B, and 22B are main portion plan views of FIGS. 19A, 20A, 21A, and 22A, FIGS. 19C, 20C, 21C, and 22C are main portion side views showing operations of the tape discharge mechanism 800 and tape pressing mechanism 900 by the edge cam mechanism 690, and FIGS. 19D, 20D, 21D, and 22D are main portion plan views of FIGS. 19C, 20C, 21C, and 22C. For convenience of description, each diagram shows only the main portion.

In FIGS. 19B, 20B, 21B, and 22B, for convenience of description, the planar cam groove 620 and crank projection 630 configured on the bottom of the rotating circular plate 610 are shown by the solid lines as transparent views. Also, when carrying out the half cutting, the rotating circular plate 610, by means of the operation of the drive portion 700, carries out the backward direction rotation (a counterclockwise rotation) as shown by an arrow B.

With reference to FIGS. 19A to 22D, a description will be given of an operation of the cutting device 20 when half-cutting the tape-like member 160. An operation and the like common to the full cutting will be described simply.

The cutting stand-by position (initial position) at the half cutting time is the same position as the initial position at the full cutting time. Consequently, the position of the cutter unit 200 shown in FIGS. 13A to 13D is the cutting stand-by position (initial position) at the half cutting time.

The diagrams shown in FIGS. 19A to 19D show a condition in which the cutter unit 200 advances from the cutting stand-by position, and is positioned in the cutting start position (the cutting preparation operation is completed). This condition is attained by the rotating circular plate 610 rotating backward (shown by an arrow B) from the cutting stand-by position shown in FIGS. 13A to 13D. In the condition in which the cutting preparation operation is completed, the cam projection 460 passes the section a of the planar cam groove 620, enters the section h, and is positioned on the boundary with the section g. While the cam projection 460 is passing the section a of the planar cam groove 620, the cutter unit 200 is positioned in the cutting stand-by position. Then, at the same time as the cam projection 460 enters the section h, the cutter unit 200 advances (moves in the +Y direction) from the cutting stand-by position toward the tape-like member 160. Then, when the cam projection 460 is positioned at the termination (the boundary with the section g) of the section h, the cutter unit 200 stops. This position is the cutting start position.

In this condition, the cutting point 211*a* of the cutter blade 210 is positioned in such a way that the printing tape 161 configuring the tape-like member 160 is cut, and the release paper 162 remains uncut. In this way, in the cutting start position when carrying out the half cutting, in the embodiment, the distance from the cutting stand-by position differs from that in the cutting start position (refer to FIGS. 14A to 14D) when carrying out the full cutting.

As heretofore described, the cutting preparation operation is carried out by means of the operation of the first movement mechanism 400. The tape pressing roller 910 is driven by this to attain a condition in which it presses against the tape discharge roller 820 across the tape-like member 160, and the tape discharge roller 820 and tape pressing roller 910 clamp the tape-like member 160. The crank projection 630 is positioned in the section k of the crank hole 556, and the cutter unit 200 is in a position in which it is lowered most in the −Z direction along the guide shaft 430.

The clutch lever 882, as it rotates in the same direction as that of the rotation of the second gear 872 of the discharge drive portion 850, carries out the rotation in the backward direction the same as the rotation direction of the rotating circular plate 610 at the half cutting time. By means of this operation, the clutch lever 882 is positioned in the section p of the edge cam projecting portion 640, and slightly presses the clutch lever 882, thereby prohibiting the rotation of the tape discharge roller 820. Consequently, when carrying out the half cutting, the rotation of the tape discharge roller 820 is prohibited during the operation of the circulatory movement at the half cutting time.

Figure 20A:
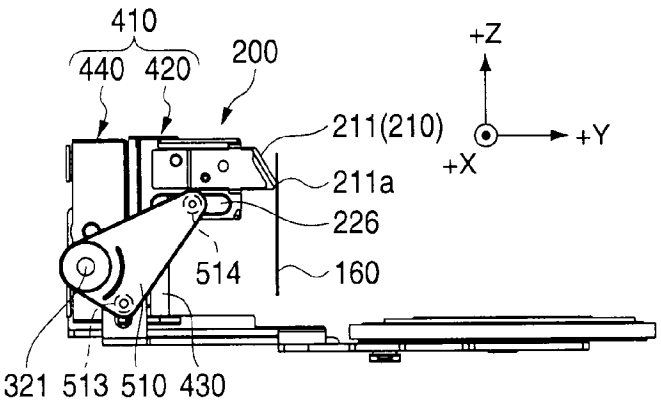
FIGS. 20A to 20D are operational illustrations of the cutting device at the half cutting time.
Figure 20B:
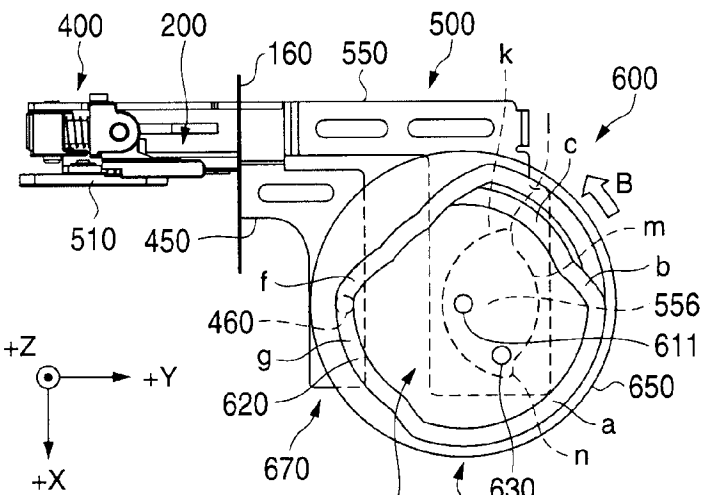
Figure 20C:
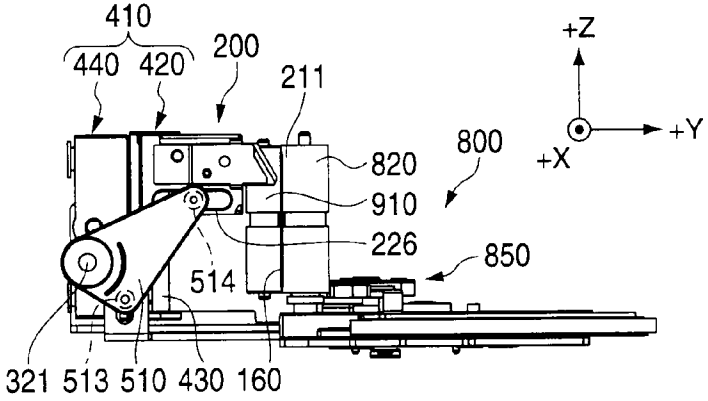
Figure 20D:
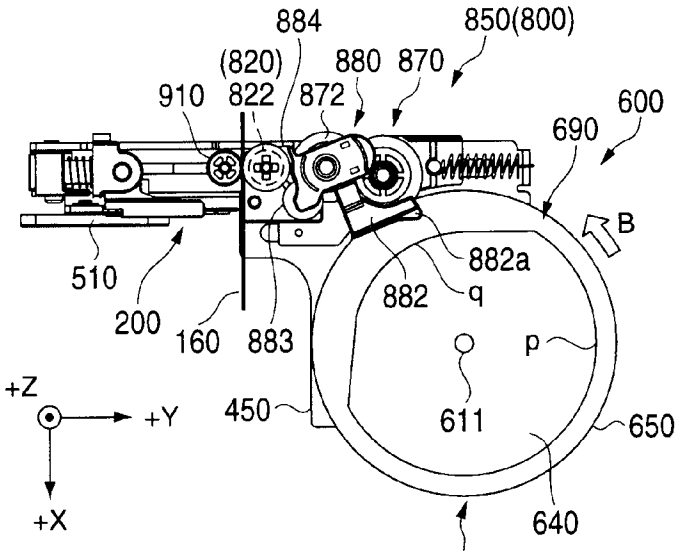

The diagrams shown in FIGS. 20A to 20B show a condition in which the cutter unit 200 is raised most. This condition shows a condition in which the cutter unit 200 moves from the cutting start position to the predetermined position, and the first cutting operation at the half cutting time is completed. In this condition, the cam projection 460 is positioned at the termination of the section g of the planar cam groove 620.

Also, the crank projection 630 attains a condition in which it is positioned on the boundary between the section n and section m of the crank hole 556, and the crank hole 556 is moved farthest in the +Y direction. The swaying plate 510 is driven by this movement of the crank hole 556 (second plate 550) to operate, and the cutter unit 200 comes into a position (the predetermined position) in which it is raised most along the guide shaft 430.

By the crank projection 630 passing the section n of the crank hole 556, the second movement mechanism 500 operates, and the cutter unit 200 rises along the guide shaft 430 from the cutting start position (refer to FIGS. 19A to 19D). By the cutter unit 200 rising, the half cutting is started (the first cutting operation is started), the cutter unit 200 rises to the predetermined position, and the half cutting is carried out. In this condition, the upper portion of the tape-like member 160 is not cut (uncut).

Also, the tape discharge roller 820 is prohibited from rotating, and the tape pressing roller 910 is clamping the tape-like member 160 together with the tape discharge roller 820.

The diagrams shown in FIGS. 21A to 21D show a condition in which the cutter unit 200 is advanced (moved in the +Y direction), and has completed the half cutting. Also, this condition shows a condition in which the cutter unit 200 moves from the predetermined position to the cutting completion position, and the second cutting operation at the half cutting time is completed. Also, the position of the cutter blade 210 in this condition is the cutting completion position. At the full cutting time too, the cutting completion position is the same position.

However, as shown in FIGS. 21A to 21D, by carrying out the second cutting operation, causing the cutter unit 200 to advance (move in the +Y direction) from the predetermined position, the uncut portion of the upper portion of the tape-like member 160 is cut utilizing the inclined portion of the blade edge 211 of the cutter blade 210, rather than raising the cutter unit 200. With this cutting, both the printing tape 161 and release paper 162 are cut in the same way as with the cutting at the full cutting time. By means of the second cutting operation, the half cutting of the embodiment provides the tape-like member 160 with a half-cut region D (refer to FIG. 24) and a full-cut region E (refer to FIG. 24) in the width direction of the tape-like member 160.

By carrying out a cutting by causing the cutter unit 200 to advance (move in the +Y direction), it is possible to shorten the movement distance of the cutter unit 200 in the up-down direction (the width direction of the tape-like member 160), and it is possible to miniaturize the cutting device 20.

Figure 21C:
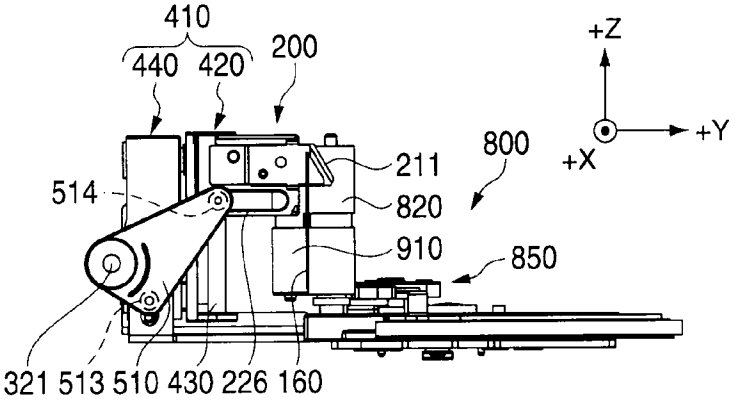
FIGS. 21A to 21D are operational illustrations of the cutting device at the half cutting time.
Figure 21D:
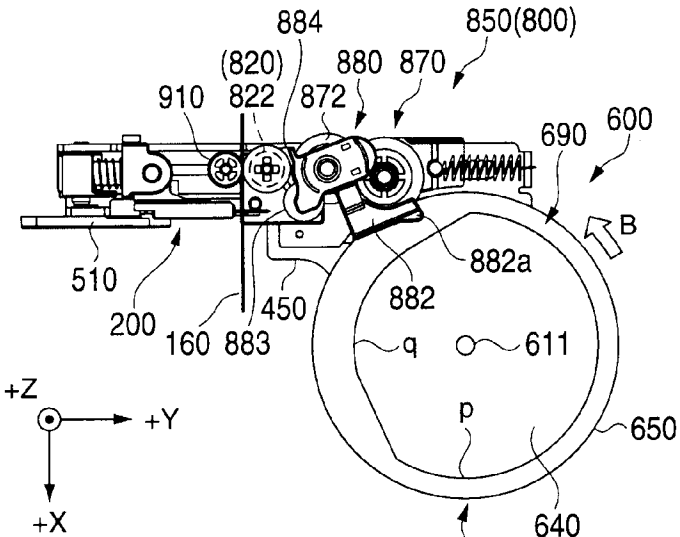
Figure 21A:
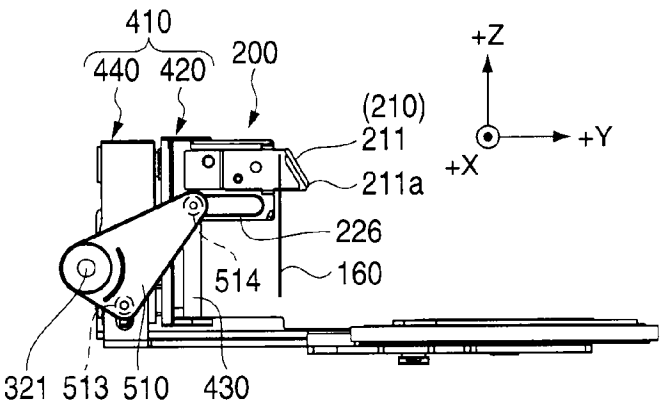
Figure 21B:
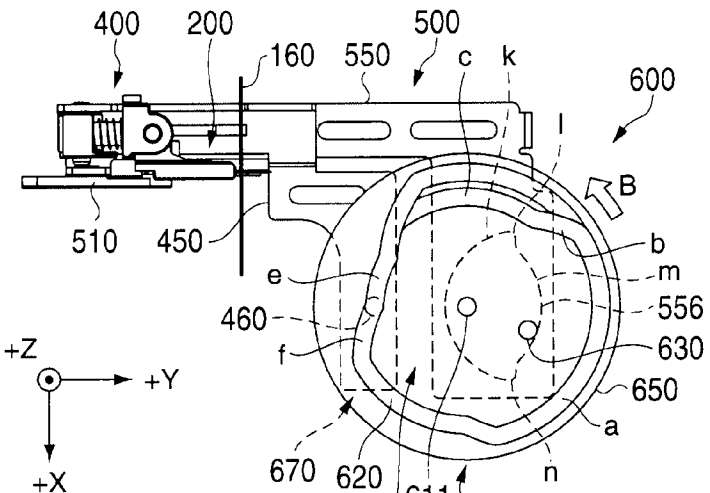

A description will be given of details of the heretofore described operation. Immediately after the cam projection 460 has entered the section f from the condition shown in FIGS. 20A to 20D (the condition in which it is positioned in the section g of the planar cam groove 620), the cutter unit 200 starts the second cutting operation. Then, as shown in FIGS. 21A to 21D, the cutter unit 200 completes the second cutting operation in the boundary position between the section f and section e of the planar cam groove 620. In this condition, as shown in FIG. 21A, the blade edge 211 of the cutter unit 200 (cutter blade 210) is moved farther in the +Y direction than the tape-like member 160.

The crank projection 630, as it is positioned in the section m of the crank hole 556, is maintaining the Z axis direction position of the cutter unit 200. Also, the clutch lever 882 is positioned in the section q of the edge cam projecting portion 640, and the tape pressing roller 910 is prohibited from rotating, and clamping the tape-like member 160 together with the tape discharge roller 820.

The cutter blade clearance portion 832 (refer to FIG. 9) included in the tape discharge casing 830 is formed so as to correspond to the trajectory along which the blade edge 211 of the cutter unit 200 (cutter blade 210) moves from the cutting start position to the cutting completion position. Then, the blade edge 211 moves inside the cutter blade clearance portion 832 during the cutting operation.

Figure 22C:
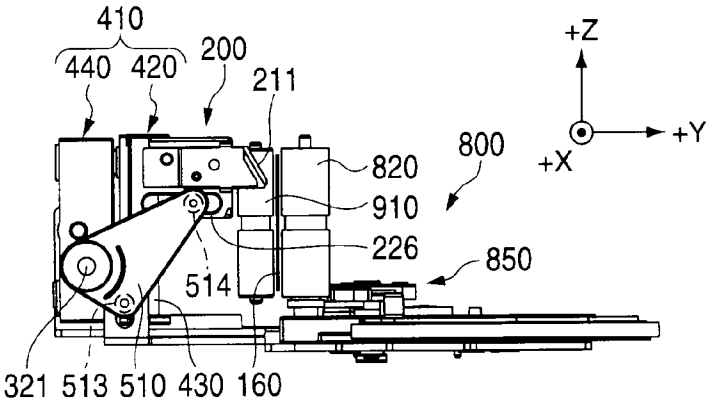
FIGS. 22A to 22D are operational illustrations of the cutting device at the half cutting time.
Figure 22D:
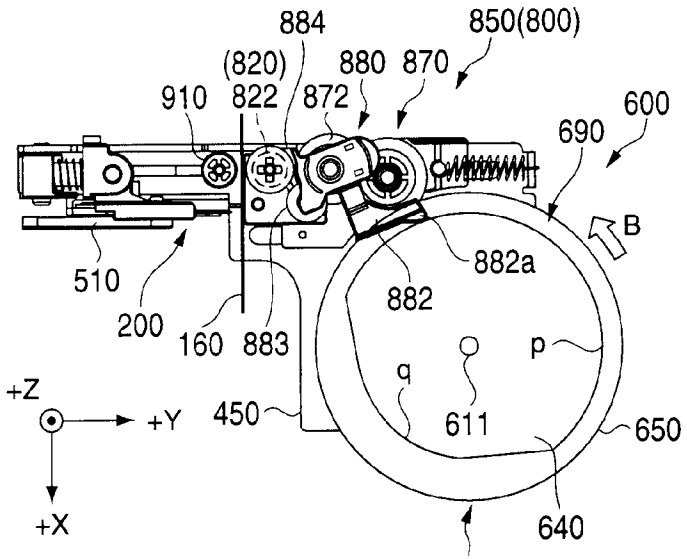
Figure 22A:
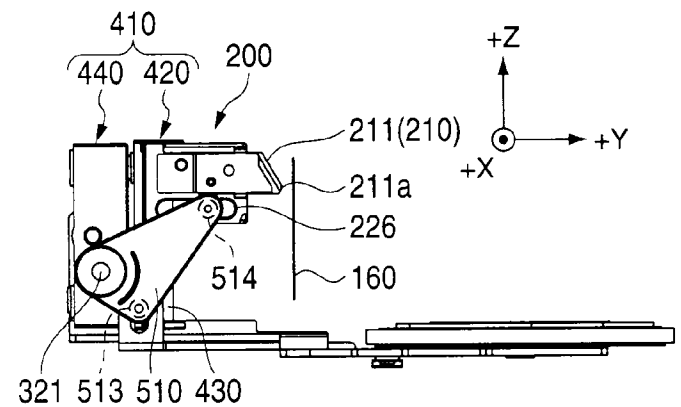
Figure 22B:
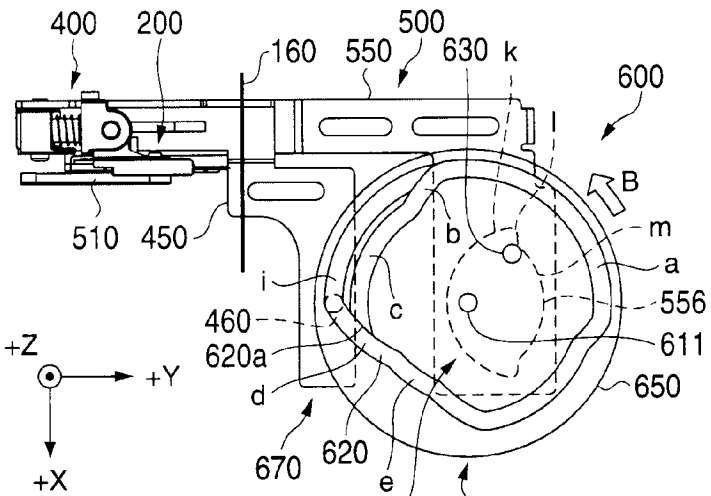

The diagrams shown in FIGS. 22A to 22B show a condition in which the withdrawal operation of the cutter unit 200 is completed. Also, the position of the cutter blade 210 in this condition is the withdrawal position. In this condition, the cam projection 460 is positioned on the boundary between the section d and section i of the planar cam groove 620.

The cam projection 460, by passing the section d of the planar cam groove 620, causes the Y axis direction position of the cutter unit 200 to move (retreat) in the −Y direction. Halfway through the section d, the cam projection 460 passes the stepped portion 620*a* connected to the section c but, in this case, the traveling direction is regulated by the stepped surface of the stepped portion 620*a*, and the cam projection 460 passes the section d along the stepped surface. Then, by the cam projection 460 being positioned on the boundary between the section d and section i of the planar cam groove 620, the movement (retreat) of the cutter unit 200 in the −Y direction finishes, and the cutter unit 200 is positioned in the withdrawal position. In this way, the withdrawal operation is carried out by means of the operation of the first movement mechanism 400.

Also, the crank projection 630 is positioned at the termination of the section m of the crank hole 556. The clutch lever 882 is positioned in the section p of the edge cam projecting portion 640, and the tape discharge roller 820 is prohibited from rotating. Also, the tape pressing roller 910 is driven by the movement of the first plate 450 to move away from the tape discharge roller 820 in the −Y direction. By means of this operation, the tape-like member 160 is released from being pressed and clamped by the tape discharge roller 820 and tape pressing roller 910.

The withdrawal position is the same in the Y axis direction as the cutting stand-by position shown in FIGS. 13A to 13D. Also, the withdrawal position is a position in which the cutting point 211*a* of the cutter blade 210 is away from the tape surface of the half-cut tape-like member 160. For this reason, in the subsequent return operation, a problem of the cutter blade 210 damaging the half-cut tape-like member 160, or the like, is prevented from occurring when the cutter blade 210 is lowered (moved in the −Z direction).

Subsequently, by the rotating circular plate 610 rotating, the cutter unit 200 carries out the return operation (refer to FIGS. 13A to 13D) from the withdrawal position to the cutting stand-by position. Hereafter, a description will be given of the return operation.

By the rotating circular plate 610 rotating, the cam projection 460 passes the section i of the planar cam groove 620. Because of this, the cutter unit 200 maintains the Y axis direction position in the withdrawal position. The crank projection 630 is positioned in the section 1 of the crank hole 556 and, by the crank hole 556 starting to move in the −Y direction, the second plate 550 also starts to move in the same way. By means of this operation, the swaying plate 510 operates, and the cutter unit 200 starts the return operation (moves in the −Z direction) along the guide shaft 430. Also, the clutch lever 882 is positioned in the section p of the edge cam projecting portion 640, and the tape discharge roller 820 maintains the condition in which it is prohibited from rotating.

By the rotating circular plate 610 rotating, the cam projection 460 passes the stepped portion 620*b* from the section of the planar cam groove 620, and enters the section a. The crank projection 630 moves to the section k of the crank hole 556, and the cutter unit 200 maintains the Z axis direction position (the Z axis direction position of the cutting stand-by position) in which it has lowered most from the withdrawal position. Also, the clutch lever 882 is positioned in the section p of the edge cam groove 640, and the tape discharge roller 820 maintains the condition in which it is prohibited from rotating.

By means of the heretofore described return operation, when the cam projection 460 is positioned in the approximately intermediate position (refer to FIGS. 13A to 13D) of the section a, it means that the rotating circular plate 610 has turned around once. Also, when this condition is attained, the detection switch portion 730 (refer to FIG. 7) disposed on the base frame 310 detects that the cutter blade 210 is in the cutting stand-by position (initial position), and outputs to the controller (not shown) the fact that the half cutting has finished (the half cutting circulatory movement has finished). In response to this detection signal, the controller stops the drive of the drive portion 700 (drive motor 710) disposed on the base frame 310.

As heretofore described, the cutter operation mechanism 300, by means of the drive (the rotation of the rotating circular plate 610) of the power transmission mechanism 600, branches power and transmits it to the first movement mechanism 400 and second movement mechanism 500 and, by bringing the first movement mechanism 400 and second movement mechanism 500 into conjunction, causes the cutter unit 200 to carry out the circulatory movement for carrying out the half cutting.

The tape printing apparatus 1, when the half cutting operation finishes, can start a next printing. When the tape printing apparatus 1 starts the next printing, the cutter unit 200, as it is positioned in the cutting stand-by position, and away from the tape-like member 160, does not impede the tape-like member 160 being fed for the printing.

Figure 23:
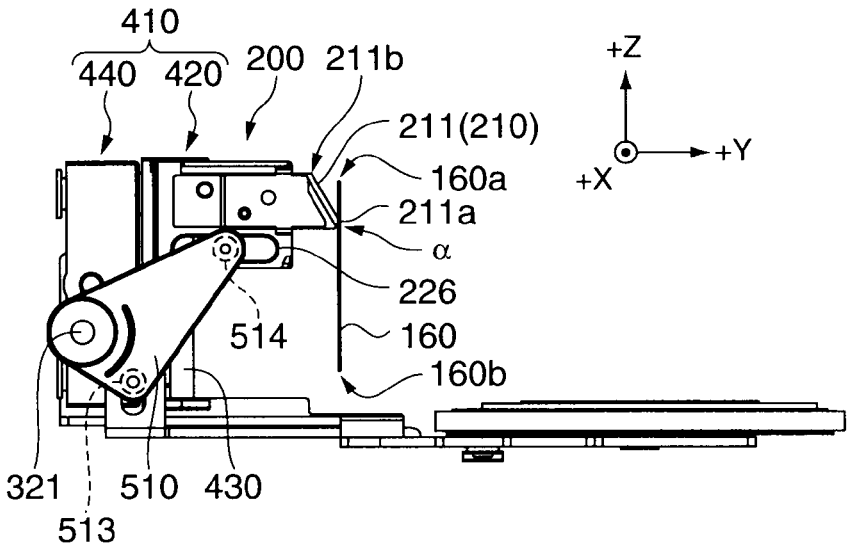
FIG. 23 is a main portion side view of the cutting device in a condition in which it has completed a first cutting operation at the half cutting time.

Herein, with reference to FIG. 23, a description will be given of the predetermined position. FIG. 23 shows a main portion side view showing a condition in which the cutter unit 200 in the cutting operation at the half cutting time has completed the first cutting operation. Then, FIG. 23 shows a condition in which the cutter unit 200 has completed the first cutting operation, and is positioned in the predetermined position. As shown in FIG. 23, in the embodiment, the predetermined position at a cutting operation time is set to a position in which a movement direction side (+Z direction side) end 211*b* of the blade edge 211 of the cutter blade 210 goes beyond an end 160*a* of the tape-like member 160 corresponding to the movement direction side (+Z direction side) of the cutter blade 210.

Then, in order to cause the cutter unit 200 to move from the cutting start position to the cutting completion position and carry out a cutting operation, firstly, the first cutting operation is carried out. With the first cutting operation, the cutting is carried out by causing the cutter unit 200 to rise (move in the +Z direction) from the cutting start position to the predetermined position. Next, the second cutting operation is carried out. With the second cutting operation, the cutting is carried out by causing the cutter unit 200 to move forward (move in the +Y direction) from the predetermined position to the cutting completion position.

Also, in the first cutting operation, at the full cutting time, the cutting is carried out with the blade edge 211 of the cutter blade 210 and, at the half cutting time, the cutting is carried out with the cutting point 211*a*. Also, in the second cutting operation, by causing the cutter unit 200 to move forward (move in the +Y direction) from the predetermined position, a cutting up to the end 160*a* of the tape-like member 160 is carried out utilizing the inclined blade portion of the cutter blade 210 at both the full cutting time and half cutting time. The position (cutting completion position) of the cutter unit 200 in which the full cutting and half cutting are completed is a position common to the full cutting and half cutting.

Figure 24:
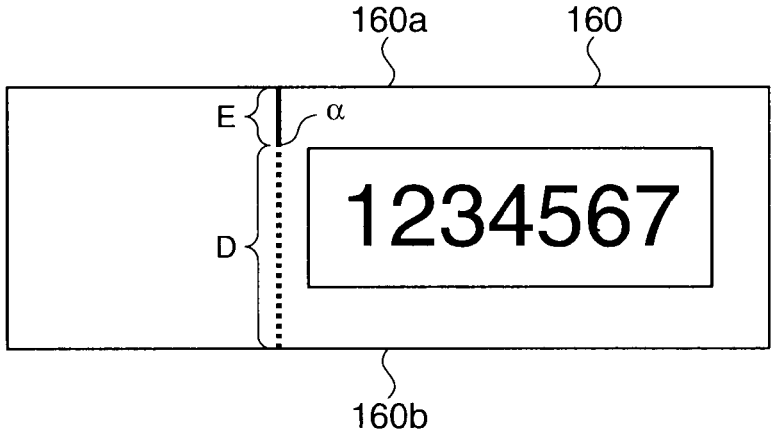
FIG. 24 is a plan view of a tape-like member cut by means of a half cutting.

Herein, with reference to FIG. 24, a description will be given of how a cutting is carried out on the tape-like member 160 cut by means of the cutting operation at the half cutting time. FIG. 24 shows a plan view of the tape-like member cut by means of the cutting operation at the half cutting time. As shown in FIG. 24, at the half cutting time, by means of the first cutting operation, the half cutting is carried out in the region shown by a reference character D (the region from the end 160*b* of the tape-like member 160 corresponding to the cutting start position side (−Z side) to a halfway position α in the width direction of the tape-like member 160 corresponding to the predetermined position). Also, by means of the second cutting operation, the full cutting is carried out in the region (the region from the halfway position α to the end 160*a*) shown by a reference character E in which the cutting has been carried out utilizing the inclined blade of the cutter blade 210, and the tape-like member 160 attains a condition in which it has been cut up to the release paper 162.

In this way, with the cutter operation mechanism 300, when the half cutting is carried out by means of the cutting operation, the half-cut region D and full-cut region E are formed in the tape-like member 160.

According to the heretofore described embodiment, it is possible to obtain the following advantages.

According to the cutting device 20 of the embodiment, by means of the cutter operation mechanism 300 which causes the cutter unit 200 to carry out the circulatory movement including the cutting preparation operation, cutting operation, withdrawal operation, and return operation, the cutter unit 200 moves in the width direction of the tape-like member 160, and carries out the cutting operation. Also, as the cutter operation mechanism 300 can change the amount of cutting into the tape-like member 160 by making the cutting start position different between the full cutting and half cutting using the same cutter unit 200 in the cutting preparation operation, it is possible to reliably carry out the full cutting and half cutting. Because of this, a need to configure the cutting device 20 of separate devices, a full cutting device and a half cutting device, is eliminated. Consequently, it is possible to share the full cutting device and half cutting device, and it is possible to achieve a miniaturization of the cutting device 20.

According to the cutting device 20 of the embodiment, in the cutting operation, the cutter operation mechanism 300, in the first cutting operation, causes the cutter unit 200 to move in the width direction from the cutting start position to the predetermined position, and in the second cutting operation, causes the cutter unit 200 to advance from the predetermined position to the cutting completion position in the direction approximately perpendicular to the tape surface of the tape-like member 160. Because of this, a need to cut the tape-like member by causing the cutter unit to move only in the width direction from the cutting start position, as heretofore known, is eliminated, and a cutting is carried out by carrying out the first cutting operation from the cutting start position to a halfway position (at the half cutting time, the position α) in the width direction of the tape-like member 160 corresponding to the predetermined position, and carrying out the second cutting operation from the halfway position. Consequently, as it is sufficient to cause the cutter unit 200 having the cutter blade 210 to move to the predetermined position, it is possible to realize a cutting device 20 with which it is possible to achieve a miniaturization in the width direction of the tape-like member 160.

According to the cutting device 20 of the embodiment, as a position in which the movement direction side end 211*b* of the blade edge 211 of the cutter blade 210 goes beyond the end 160*a* of the tape-like member 160 corresponding to the movement direction side of the cutter blade 210 is made the predetermined position, when the second cutting operation is carried out, it is possible, utilizing the inclined blade portion of the cutter blade 210 (blade edge 211), to cut a portion of the tape-like member 160 from the predetermined position to the end 160*a* thereof corresponding to the movement direction side of the cutter blade 210. Consequently, it is possible to realize the cutting device 20 with which it is possible to achieve the miniaturization in the width direction of the tape-like member 160.

According to the cutting device 20 of the embodiment, when the cutter operation mechanism 300 carries out the half cutting, as it forms the half-cut region D and full-cut region E in the tape-like member 160, even with the cutting device 20 having achieved the miniaturization in the width direction of the tape-like member 160, it is possible to reliably carry out the half cutting. Then, it is possible to maintain the user-friendliness of the half cutting which makes it easy to strip the cut tape-like member 160 from the release paper 162.

According to the tape printing apparatus 1 of the embodiment, as it uses the cutting device 20 with which it is possible to share the full cutting device and half cutting device, and it is possible to achieve the miniaturization in the width direction of the tape-like member 160, it is possible to realize a miniaturization of the tape printing apparatus 1. Also, as the width direction of the tape-like member 160 is the thickness (height) direction of the tape printing apparatus 1, it is possible to reduce the thickness (height) of the tape printing apparatus 1.

According to the tape printing apparatus 1 of the embodiment, as it is possible to achieve the miniaturization and reduction in thickness by the portability, or the like, of the tape printing apparatus 1 improving, the user-friendliness of the tape printing apparatus 1 improves.

As the cutting device 20 of the embodiment moves in the width direction of the tape-like member 160 and carries out the cutting operation on the tape-like member 160, it is possible to carry out the cutting with an extremely weak force in comparison with a heretofore known cutting device which carries out a press cutting in the form of scissors. For this reason, as well as it being possible to achieve the miniaturization and reduction in thickness, it is possible to realize energy saving. Also, with the tape printing apparatus 1 including this kind of cutting device 20 too, it is possible to realize energy saving.

The invention, not being limited to the heretofore described embodiment, can be implemented by making various changes, improvements, or the like, without departing from the scope of the invention. Modification examples will be described below.

With the cutting device 20 (tape printing apparatus 1) of the embodiment, the full cutting and half cutting are carried out on a widest tape-like member 160, among tape-like members having a plurality of kinds of width which can be used for the tape printing apparatus 1. Also, the predetermined position is also set for the widest tape-like member 160. Consequently, when a tape-like member 160 narrow in width other than the widest tape-like member 160 is used, a narrower full-cut region E can also be formed in the tape-like member 160 cut in the half cutting. Even with tape-like members differing in width, by the upper ends (in the embodiment, the end 160*a* of the tape-like member 160 corresponding to the movement direction side of the cutter blade 210) of the tape-like members, each of which is housed in and reeled out from the tape cartridge 15, being set to the same position, a uniform full-cut region E can also be secured for the tape-like members cut in the half cutting.

What is claimed is:

1. A cutting device for carrying out a cutting operation on a tape-like member, the cutting device comprising:

a cutter unit having an inclined cutter blade; and a cutter operation mechanism that causes the cutter unit to carry out a first cutting operation, causing the cutter unit to move in a width direction with respect to the tape-like member from a cutting start position to a predetermined position, and a second cutting operation, causing the cutter unit to advance from the predetermined position to a cutting completion position in a direction approximately perpendicular to a tape surface of the tape-like member;

wherein the cutter operation mechanism causes the cutter unit to execute a circulatory movement including a cutting preparation operation that causes the cutter unit to advance toward the tape-like member from a cutting stand-by position to the cutting start position, a cutting operation that causes the cutter unit to move from the cutting start position to a cutting completion position, a withdrawal operation that causes the cutter unit to retreat from the cutting completion position to a withdrawal position, and a return operation that causes the cutter unit to return from the withdrawal position to the cutting stand-by position.

2. The cutting device according to claim 1, wherein the cutting start position is different for a half cutting operation than for a full cutting operation.

3. The cutting device according to claim 1, wherein the predetermined position in the first cutting operation is a position beyond an end of the tape-like member to which a movement direction side end of the cutter blade moves.

4. The cutting device according to claim 1, wherein the first cutting operation is a half cutting operation and the second cutting operation is a full cutting operation.

5. A tape printing apparatus comprising:

the cutting device according to claim 1; and a printing drive device that carries out a printing on the tape-like member by driving a tape cartridge that houses the tape-like member.

* * * * *